US007150456B2

(12) United States Patent
Gerstenberger et al.

(10) Patent No.: US 7,150,456 B2
(45) Date of Patent: Dec. 19, 2006

(54) SHEET TRANSPORT DRUM FOR A MACHINE PROCESSING PRINTING-MATERIAL SHEETS

(75) Inventors: Markus Gerstenberger, Heidelberg (DE); Christian Hieb, Neuhofen (DE); Karl-Heinz Helmstädter, Heidelberg (DE); Raimund Schröder, Hockenheim (DE); Thorsten Eckart, Ilvesheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 111 days.

(21) Appl. No.: 10/698,075

(22) Filed: Oct. 30, 2003

(65) Prior Publication Data

US 2004/0084837 A1 May 6, 2004

(30) Foreign Application Priority Data

Oct. 30, 2002 (DE) ..... 102 50 447

(51) Int. Cl.
*B65H 5/12* (2006.01)

(52) U.S. Cl. ..... 271/276

(58) Field of Classification Search ..... 271/275–277
See application file for complete search history.

(56) References Cited

U.S. PATENT DOCUMENTS 3,986,455 A 10/1976 Jeschke et al.
4,127,265 A * 11/1978 Wirz et al. ..... 271/260
4,145,040 A * 3/1979 Huber ..... 271/276
4,202,268 A * 5/1980 Becker ..... 101/409
4,202,542 A * 5/1980 Lammers et al. ..... 271/276
4,204,471 A * 5/1980 Becker ..... 101/410
4,334,473 A * 6/1982 Becker et al. ..... 101/409
4,437,659 A * 3/1984 Caron et al. ..... 271/276
4,440,388 A * 4/1984 Divoux et al. ..... 271/195
5,172,634 A * 12/1992 Iwamoto ..... 101/410
5,183,252 A * 2/1993 Wolber et al. ..... 271/276
5,241,907 A * 9/1993 Dorsam et al. ..... 101/409
5,291,260 A * 3/1994 Johnson et al. ..... 399/305
5,329,301 A * 7/1994 Balzeit et al. ..... 346/134
5,383,001 A * 1/1995 Bosy ..... 355/73
5,456,458 A * 10/1995 Haupenthal ..... 271/276
5,480,137 A 1/1996 Haupenthal
5,480,138 A * 1/1996 Haupenthal et al. ..... 271/276

(Continued)

FOREIGN PATENT DOCUMENTS

CA 1 076 620 4/1980

(Continued)

*Primary Examiner*—Gene C. Crawford
*Assistant Examiner*—Matthew J. Kohner
(74) *Attorney, Agent, or Firm*—Laurence A. Greenberg; Werner H. Stemer; Ralph E. Locher

(57) ABSTRACT

A machine processing printing-material sheets contains a first sheet transport drum and a second sheet transport drum disposed immediately after the first sheet transport drum in a sheet transport direction. The first sheet transport drum has gripper systems which describe a gripper flight circle during its rotation and a drum profile deviating substantially from a circular shape with outer contour regions running between the gripper systems and set back from the gripper flight circle. The second sheet transport drum has a sheet support surface with pneumatic grooves formed therein. The sheet support surface is composed of a first and second comb segments each with segment prongs. The pneumatic grooves are introduced into the segment prongs of at least one of the comb segments. The pneumatic grooves are preferably introduced both into the segment prongs of the first comb segment and into the segment prongs of the second comb segment.

17 Claims, 12 Drawing Sheets

U.S. PATENT DOCUMENTS

| | | | | |
|---|---|---|---|---|
| 5,542,659 | A * | 8/1996 | Haupenthal | 271/108 |
| 6,038,976 | A * | 3/2000 | Helmstadter et al. | 101/410 |
| 6,209,867 | B1 * | 4/2001 | Madsen et al. | 271/276 |
| 6,450,496 | B1 * | 9/2002 | Hebert et al. | 271/276 |
| 6,454,259 | B1 * | 9/2002 | Madsen et al. | 271/276 |
| 6,561,510 | B1 * | 5/2003 | Ozaki | 271/276 |
| 6,578,846 | B1 * | 6/2003 | Maul et al. | 271/277 |
| 6,581,517 | B1 | 6/2003 | Becker et al. | |
| 6,659,456 | B1 * | 12/2003 | Hieb | 271/275 |
| 6,722,652 | B1 * | 4/2004 | Kobayashi et al. | 271/276 |
| 6,896,258 | B1 * | 5/2005 | Kobayashi et al. | 271/276 |
| 2002/0046667 | A1 | 4/2002 | Frankenberger et al. | |
| 2003/0189287 | A1 * | 10/2003 | Fukui | 271/275 |

FOREIGN PATENT DOCUMENTS

| | | | |
|---|---|---|---|
| DE | 1 964 780 | | 7/1971 |
| DE | 69 49 816 | | 6/1972 |
| DE | 23 54 418 | A1 | 5/1975 |
| DE | 25 52 300 | A1 | 4/1977 |
| DE | 26 44 232 | A1 | 4/1977 |
| DE | 26 32 243 | A1 | 1/1978 |
| DE | 37 10 341 | A1 | 11/1987 |
| DE | 43 15 549 | A1 | 11/1994 |
| DE | 198 45 214 | A1 | 4/2000 |
| DE | 100 42 885 | A1 | 3/2002 |

* cited by examiner

SHEET TRANSPORT DRUM FOR A MACHINE PROCESSING PRINTING-MATERIAL SHEETS

BACKGROUND OF THE INVENTION

Field of the Invention

The present invention relates to a sheet transport drum for a machine processing printing-material sheets. The drum has a sheet support surface and pneumatic grooves in the sheet support surface.

Published, Non-Prosecuted German Patent Application DE 37 10 341 A1 describes such a sheet transport drum, in which the pneumatic grooves are disposed running in the shape of an arrow and forming vertices. Air nozzles, to which a vacuum can be applied cyclically by a control device, open into the vertices. The vertices and therefore also the air nozzles are disposed within a region of the sheet support surface which can be covered by a minimum sheet format. This type of configuration results in that adjustments for a sheet format change are avoided and it is ensured that the printing-material sheets of all the sheet formats that can be processed in a sheet-printing press containing the sheet transport drum rest exactly on the sheet support surface.

A disadvantage with the sheet transport drum, which, in respect of the present invention, represents the closest prior art, is that the drum is completely unsuitable for use as what is known as a storage drum in a turner device for turning the printing-material sheets. This is because, in the case of a storage drum, technical preconditions for sheet format changes are absolutely necessary in order to be able to adjust the position of the sheet trailing edge of the printing-material sheet resting on the storage drum during turning as a function of its respective sheet format length when setting up the turner device (sheet format change) relative to a gripper system of a turner drum which picks up the printing-material sheet as it is turned by the storage drum. Only by use of such a sheet format change can it be ensured that the gripper system grips the sheet trailing edge as the respective printing-material sheet is turned and does not reach past the sheet trailing edge.

Published, Non-Prosecuted German Patent Application Nos. 25 52 300 and 26 44 232, and German Utility Model No. 69 49 816, describe a sheet transport drum containing carrier disks provided with grooves in which vacuum arms are led between flanks of the grooves. However, this further prior art does not provide any helpful contribution to solving the problem thrown up in connection with the first-mentioned document (DE 37 10 341 A1).

SUMMARY OF THE INVENTION

It is accordingly an object of the invention to provide a sheet transport drum for a machine processing printing-material sheets that overcomes the above-mentioned disadvantages of the prior art devices of this general type, which is suitable for use as a storage drum in a turner device and has pneumatic grooves in the sheet support surface.

With the foregoing and other objects in view there is provided, in accordance with the invention, a sheet transport drum for a machine processing printing-material sheets. The sheet transport drum contains at least one sheet support surface having pneumatic grooves formed therein. The sheet support surface has a first comb segment with segment prongs and a second comb segment with segment prongs.

The pneumatic grooves are introduced into the segment prongs of at least one of the first and second comb segments.

The object is achieved by a sheet transport drum that is characterized in that the sheet support surface is composed of a first comb segment with segment prongs and a second comb segment with segment prongs, and in that the pneumatic grooves are introduced at least into the segment prongs of one of the comb segments.

Accordingly, only the segment prongs of the first comb segment or only the segment prongs of the second comb segment can be provided with the pneumatic grooves. Preferably, however, the segment prongs of the first comb segment are provided with some of the pneumatic grooves, and the segment prongs of the second comb segment with the remainder of the pneumatic grooves. The pneumatic grooves can have air (blown air and/or vacuum) at a positive pressure and/or a negative pressure applied to them and are constructed as slots in each case provided with a bottom surface which extend longitudinally, substantially at right angles to an axis of rotation of the sheet transport drum and in the circumferential direction of the sheet transport drum. The pneumatic grooves can be connected only to a blown-air or positive-pressure producer (for example a compressor) or only to a vacuum or negative-pressure producer (what is known as a vacuum source) or, by a pneumatic control device (for example a rotary valve), alternately continuously connected to the positive-pressure producer and the negative-pressure producer. As a result of subdividing the sheet support surface into the first comb segment and the second comb segment, a sheet format length changeover of the sheet transport drum, and therefore a variable position predetermination of the sheet trailing edge of the printing-material sheet in each case resting simultaneously on both comb segments, is possible. The sheet transport drum segmented in this way is very well suited for its use as a variable sheet format length storage drum of a sheet turner device but also for other intended uses which presuppose a sheet format length adjustment and, at the same time, the presence of the pneumatic grooves, which are aimed at the printed-material sheets guided on the sheet transport drum. For example, the sheet transport drum according to the invention can also be used as what is known as a deliverer drum of a sheet deliverer.

In a development which is advantageous with regard to sucking on the respective printing-material sheet both within its leading half-sheet and within the trailing half-sheet of the printing-material sheet, the pneumatic grooves are introduced both into the segment prongs of the first comb segment and into the segment prongs of the second comb segment and are formed as suction grooves. During printing operation, the pneumatic grooves of the first comb segment fix the leading half-sheet and the pneumatic grooves of the second comb segment fix the trailing half-sheet on the respective comb segment. The pneumatic grooves introduced into the segment prongs of the first comb segment can certainly be introduced only into these segment prongs, but do not have to be. The last-named pneumatic grooves can also be introduced only to some extent into the segment prongs and thus extend beyond the segment prongs into a prong-less region of the first comb segment which may be present. In an analogous way to the first comb segment, it is true of the second comb segment that each of the pneumatic grooves introduced into the segment prongs of the second comb segment can extend either only within the pronged region of the second comb segment or beyond the pronged region.

In a development which is advantageous with regard to a high efficiency of the pneumatic grooves which is independent of the sheet format length, each of the pneumatic grooves is formed as a suction and restrictor groove, to which a vacuum sucking on the respective printing-material sheet can be applied and which is profiled such that the vacuum is maintained, at least to an extent which is sufficient to suck on the printing-material sheet, even given incomplete coverage of the suction and restrictor groove by the respective printing-material sheet. As a result of forming the pneumatic grooves as restrictor grooves, negative effects of a leakage air stream are thus minimized, the leakage air stream inevitably penetrating into the respective pneumatic groove within the longitudinal groove section that is free of the sheet and thus open to the environment. The restricting effect ensures that the leakage air stream does not substantially impair the suction force of the restrictor groove and therefore the sheet adhesive force in functional terms or reduces it only insignificantly.

In order to ensure a high efficiency of the pneumatic grooves which is independent of the sheet format width, these can be disposed only in the region of the minimum sheet format width, so that segment prongs located outside the minimum sheet format width have no pneumatic grooves at all which otherwise would remain uncovered during the processing of printing-material sheets of minimum format width. The pneumatic grooves located within the minimum sheet format width are sufficient to suck on and securely hold firmly a printing-material sheet that exceeds the minimum format width, for example a printing-material sheet of the maximum format width that can be processed in the machine.

Alternatively, a single shut-off valve or a plurality of shut-off valves can also be provided in order to cut off from the vacuum source all the pneumatic grooves which are located outside the respective format width of the printing-material sheet and are therefore completely uncovered. By use of the shut-off valve or these shut-off valves, adaptation to the format width can be carried out, that is to say the number of pneumatic grooves required for the various sheet format widths are activated and the other pneumatic grooves are deactivated, so that no leakage air can flow in through the latter.

In a development which is advantageous with regard to the venting and ventilation of the pneumatic grooves, in each case carried out at least once during each full revolution of the sheet transport drum, the pneumatic grooves are connected to a rotary valve which is configured to apply air cyclically to the pneumatic grooves as a function of rotational angle positions assumed by the sheet transport drum during the rotation of the latter. The rotary valve is configured such that it maintains a fluidic connection between the pneumatic grooves and the respective pneumatic source (vacuum source or blown air source) not over the entire rotational angle of the sheet transport drum, amounting to 360°, but only over at least a subregion of the rotational angle. Depending on how the rotary valve is specifically configured for the respective application, the rotary valve controls the periodic application of vacuum or the periodic application of blown air to the pneumatic grooves or the periodic application of air to the pneumatic grooves, in which the application of vacuum and the application of blown air is continuously carried out alternately. Irrespective of the manner of application of air, the latter is switched on by the rotary valve as soon as the sheet transport drum has reached a specific rotational angle position in the course of its revolution and is only switched off again as soon as the sheet transport drum has reached another rotational angle position in the course of the revolution. The rotary valve has a first control groove, which covers an angular range in which the printing-material sheet covers the pneumatic grooves completely, and a second control groove, which is located in an angular range in which the pneumatic grooves are not completely covered by the printing-material sheet at every time.

In a development which is advantageous with regard to the integration of a pneumatic coupling into the rotary valve, the rotary valve contains a first valve part, a second valve part and a third valve part, and the three valve parts are disposed so as to be aligned axially and on one another in a sandwich construction. The geometric axis of rotation of the rotary valve, with respect to which the three valve parts are disposed centrally, and that of the entire sheet transport drum are thus one and the same. The valve parts, which are preferably substantially formed in the manner of disks, are disposed close to one another, so that, with regard to the rotary valve, the first valve part and the third valve part are outer valve parts and the second valve part, disposed between the first and the third valve parts, is an inner valve part. Advantageous with regard to high compactness and low fabrication costs is the multifunctional use of the second valve part both as a rotating control part of the rotary valve and also as a half-coupling of the pneumatic coupling. The other half-coupling of the pneumatic coupling can be formed by the third valve part.

In a development which is likewise advantageous with regard to the assembly of the rotary valve and the pneumatic coupling to form a single structural unit, the first valve part and the third valve part form an air outlet and an air inlet of the rotary valve, and the second valve part forms an air passage of the rotary valve. Which of the two outer valve parts forms the air inlet and which forms the air outlet depends on the type of application of air controlled by the rotary valve and the assignment of the outer valve parts to the sheet transport drum and to a machine frame. Assuming that the first valve part is fixed to the machine frame in such a way that the first valve part is secured against rotation together with the sheet transport drum, and that the third valve part is fitted to the sheet transport drum in such a way that the third valve part necessarily corotates with the sheet transport drum, then, in the case of vacuum being applied to the pneumatic grooves, the third valve part would form the (vacuum) air inlet and the first valve part would form the (vacuum) air outlet and instead, in the case of blown air being applied to the pneumatic grooves, the first valve part would form the (blown air) air inlet and the third valve part would form the (blown air) air outlet. The inner, second valve part forms the air passage, which conducts the vacuum or blown air from one of the two outer valve parts to the other, irrespective of the type of application of air to the pneumatic grooves.

In a development which is advantageous with regard to the formation of the pneumatic coupling such that it can be adjusted as a function of the sheet format, the third valve part is mounted such that it can be rotated relative to the second valve part during a sheet format changeover of the sheet transport drum, and the second valve part is mounted such that it can be rotated relative to the first valve part during each operational drum revolution. Accordingly, the third valve part is mounted in such a way that, in the course of the sheet format changeover of the sheet transport drum, the third valve part is rotated positively relative to the second valve part. In order to achieve this, the second and the third valve part are in each case firmly connected to another of the two comb segments so as to rotate with it. The third valve part is firmly connected so as to rotate with that comb segment which is rotated relative to the respective other comb segment for the purpose of the sheet format changeover. The third valve part and the comb segment firmly connected so as to rotate with the latter are together rotated relative to the second valve part and to the other comb segment firmly connected so as to rotate with the latter during the sheet format changeover. According to the development described here, the second valve part is mounted in such a way that, during each revolution of the comb segments carried out during printing operation, it is rotated positively relative to the first valve part together with the comb segments.

In a development which is advantageous with regard to control of the vacuum in the pneumatic grooves of the one comb segment, unimpaired by vacuum faults in the pneumatic grooves of the other comb segment, the second valve part has a first air control hole, to which the pneumatic grooves of the first comb segment are connected, and a second air control hole, to which the pneumatic grooves of the second comb segment are connected, and the first air control hole is disposed to be offset by a central angle relative to the second air control hole. Accordingly, each of the two pneumatic loads (row of pneumatic grooves of the first comb segment, row of pneumatic grooves of the second comb segment) is controlled cyclically by another of the two air control holes of the second valve part. As viewed in the circumferential direction of the rotary valve, the first air control hole is offset relative to the second air control hole by a specific angle whose vertex is the axis of rotation of the rotary valve, and is disposed separately from the second air control hole. A rise in air pressure (drop in vacuum) in the pneumatic grooves of the one comb segment and thus in the air control hole connected to these pneumatic grooves, caused by a rise in air pressure in the pneumatic grooves of the other comb segment, and thus in the air control hole connected to the last-named pneumatic grooves, owing to an external fault, is safely avoided. For example, in the case of complete coverage by the respective printing-material sheet of the pneumatic grooves of the first comb segment, leading in the drum rotational direction, and, at the same time, only incomplete coverage by the printing-material sheet of the pneumatic grooves of the trailing, second comb segment, the vacuum in the completely covered pneumatic grooves of the first comb segment can be maintained without fault in spite of a drop in the vacuum in the pneumatic grooves of the second comb segment caused by the incomplete coverage of the pneumatic grooves of the second comb segment.

In a development that is advantageous with regard to the particularly compact configuration of the rotary valve, the two air control holes have substantially one and the same radial spacing relative to the axis of rotation of the rotary valve. Accordingly, the two air control holes lie substantially on one and the same imaginary circular arc, whose center is the axis of rotation of the rotary valve. As a result, the radial extents of the rotary valve are kept small, as opposed to a conceivable alternative configuration, in which the air control holes lie on different concentric circular arcs.

In a development which is likewise advantageous with regard to the compactness of the rotary valve, the first valve part has at least one air control groove which is assigned co-operatively both to the first air control hole and to the second air control hole, so that the two air holes come to overlap the air control groove successively during each drum revolution. Accordingly, the air control groove interacts with the first air control hole when it is first opposite the latter, and interacts with the second air control hole when it is subsequently opposite the latter. Because of the rotation of the second valve part, necessarily accompanying the rotation of the comb segments, its air control holes successively come from time to time to lie opposite the air control groove of the first valve part, not corotating with the comb segments. Each of the air control holes, together with the air control groove, forms a flow duct through which the controlled air (blown air or preferably vacuum) flows, and through which the controlled air either flows from the respective air control hole into the air control groove or from the latter into the respective air control hole, as long as they are opposite.

In a development which is advantageous with regard to the air control of at least three different pneumatic loads (row of pneumatic grooves of the first comb segment, row of pneumatic grooves of the second comb segment, row of sheet trailing edge vacuum nozzles) of the sheet transport drum, the second valve part has at least a third air control hole, which is disposed in such a way that the third air control hole lies on a different imaginary circular arc than the other two air control holes and comes to overlap the air control groove during each drum revolution. Accordingly, the third air control hole is located radially either further in or preferably further out than the first and the second air control holes, and the air control groove extends in the radial direction of the rotary valve to such an extent that the air control groove covers both the (preferably inner) imaginary circular arc on which the first and second air control grooves revolve around the axis of rotation of the rotary valve and also the (preferably outer) imaginary circular arc on which the third air control hole revolves around the axis of rotation. The air control groove thus successively co-operates once in each case with the three air control holes in the course of each revolution of the second valve part. The third air control hole is disposed to be offset, that is to say offset by a central angle, in the circumferential direction of the rotary valve, both relative to the first air control hole and relative to the second air control hole.

In a development which is constructionally beneficial with regard to connecting the individual pneumatic loads to the rotary valve, the first air control hole is formed as a passage hole which is respectively open toward the first valve part and toward the third valve part, and both the second air control hole and the third air control hole are each formed as an angled or oblique hole. Accordingly, the passage hole passes through the second valve part in such a way that the passage hole in each case has an opening both in the planar surface of the second valve part which faces the first valve part and in its planar surface which faces the third valve part. Each of the two angled or oblique holes has an opening in the planar surface that faces the first valve part, and a further opening in the circumferential surface of the second valve part, but no opening in the planar surface that faces the third valve part. Each of the two angled or oblique holes can be formed, as an angled hole, from two bores which meet each other at an angle, preferably a right angle, namely a bore (what is known as an axial bore) which is substantially axially parallel relative to the rotary valve and a bore (what is known as a radial bore) aligned substantially radially relative to the rotary valve. In this case, the axial bore, as it is known, opens in the planar surface of the central, second valve part that faces the first valve part but not in its planar surface that faces the third valve part, and what is known as the radial bore opens in the circumferential surface of the second valve part.

Alternatively, the respective angled or oblique hole, in its configuration as an oblique hole, can run oriented obliquely relative to the axis of rotation of the rotary valve, the oblique hole opening with its one end in the planar surface of the second valve part that faces the first valve part and with its other end in the circumferential surface of the second valve part.

In both variants of the angled or oblique holes, a pipe stub for a hose line to be pushed on or for a pipeline can be plugged into the circumferential opening of the respective angled or oblique hole.

In a development which is advantageous with regard to the flutter-free guidance and smooth tensioning of the printing-material sheet respectively transported on the sheet transport drum, a row of vacuum nozzles that fixes the sheet trailing edge of the printing-material sheet respectively resting on the sheet support surface is connected to the third air control hole. The activation of the application of vacuum to this row of vacuum nozzles, also referred to as sheet trailing edge suckers, via the third air control hole can be carried out with a time offset with respect to the activations of the applications of vacuum to the pneumatic grooves carried out via the first and second air control holes.

In a development which is advantageous with regard to the adjustment, required in the case of the sheet format changeover, of a first air collecting line connected to the rotary valve relative to a similar, second air collecting line, the pneumatic grooves are connected to a pneumatic coupling which is configured to be adjustable as a function of the sheet format and which has two half-couplings. In this case, the pneumatic grooves of the first comb segment can be connected via the first air collecting line to a first of the half-couplings, and the pneumatic grooves of the second comb segment can be connected via the second air collecting line to a second of the half-couplings. During the sheet format changeover, the first comb segment, the first air collecting line and the first half-coupling are rotated or pivoted relative to the second comb segment, to the second air collecting line and to the second half-coupling by a specific angle, which is given by the sheet format length difference to be corrected. During the pivoting movement, the first air collecting line maintains its position relative to the first comb segment and the first half-coupling unchanged, and the first air collecting line is not deformed either. The adjustment of the first comb segment relative to the second comb segment is compensated for by the relative movement between the two half-couplings. The first air collecting line can therefore be rigid (inflexible) and therefore does not need to be a hose whose flexibility would also permit the aforesaid adjustment.

In a development that is to be viewed in close conjunction with the development explained previously, one of the half-couplings is mounted such that it can be rotated relative to the other half-coupling as a function of different sheet format lengths. This format dependence is preferably ensured by each of the two half-couplings being firmly connected so as to rotate with another of the two comb segments, so that, when the sheet transport drum is being set up to a new sheet format length, the half-coupling firmly connected so as to rotate with the first comb segment is rotated positively together with the first comb segment relative to the half-coupling firmly connected so as to rotate with the second comb segment, which is stationary in the process. As a result of the rotation of the one half-coupling, a first coupling chamber introduced into the latter, which is preferably formed as a groove in the shape of a circular arc, is pivoted relative to a second coupling chamber from the coupling position corresponding to the preceding sheet format length into the coupling position corresponding to the new sheet format length. The second coupling chamber is identical to the first air control hole already mentioned. During printing operation, the position of the first comb segment relative to the second comb segment is fixed, and thus the position of the half-coupling firmly connected so as to rotate with the first comb segment is also fixed relative to the other half-coupling.

In a development which is advantageous with regard to the multifunctional use of one of the two half-couplings, precisely this half-coupling is an integral constituent part of a rotary valve which applies air cyclically to the pneumatic grooves as a function of rotational angle positions assumed by the sheet transport drum during the rotation of the latter. The half-coupling forming the constituent part of the rotary valve is preferably that half-coupling which is firmly connected so as to rotate with the second comb segment and which is at a standstill during the sheet format changeover.

In a development which is advantageous with regard to reducing the total number of parts of the rotary valve and of the pneumatic coupling, the rotary valve contains valve parts which rest on one another and are coaxial with one another, and one of these valve parts is formed by the half-coupling that forms the integral constituent part of the rotary valve. The valve parts are preferably three pieces, and the central one of these three valve parts is identical with the half-coupling forming the integral constituent part of the rotary valve.

The scope of the invention also includes a machine processing the printing-material sheets which, inter alia, is equipped with the sheet transport drum described previously with regard to its features essential to the invention and its possible developments and which, in the following text, will be designated the second sheet transport drum to distinguish it better.

The machine processing the printing-material sheets contains a first sheet transport drum and the (already previously described) second sheet transport drum. The second sheet transport drum is disposed immediately after the first sheet transport drum in a sheet transport direction of the machine. The first sheet transport drum has gripper systems which describe a gripper flight circle during its rotation and a drum profile deviating substantially from a circular shape with outer contour lines running between the gripper systems and set back from the gripper flight circle. The second sheet transport drum has a sheet support surface, composed of the first comb segment with its segment prongs and the second comb segment with its segment prongs, and the pneumatic grooves being introduced into the segment prongs of at least one of the comb segments.

Each of the gripper systems of the first sheet transport drum can be formed as a gripper bar, as it is known, which has clamping grippers disposed in a row for firmly clamping the printing-material sheet to be held firmly on the first sheet transport drum in each case. When the first sheet transport drum rotates, the gripper systems move along a movement path that is designated by the gripper flight circle. The drum profile of the first sheet transport drum, to be viewed in the direction of an axis of rotation of the first sheet transport drum, deviates considerably from that circular shape possessed, for example, by the cross section of an impression cylinder fitted with gripper systems. The substantial deviation of the drum profile of the first sheet transport drum from the circular shape is determined by the aforementioned outer contour lines of the drum profile. Each of the outer contour lines extends substantially from one to the corresponding other of the gripper systems in each case.

For example, the first sheet transport drum can have three gripper systems in each case offset by an angle of 120° in relation to one another, so that the drum profile substantially has the shape of an equilateral triangle, whose sides are the aforesaid outer contour lines.

The drum profile is preferably substantially oval or rhomboidal, the first sheet transport drum having only two gripper systems, which are disposed offset by an angle of 180° and thus located diametrically opposite each other. Each of the outer contour lines of this drum profile is substantially convex and falls off obliquely toward each of the two gripper systems.

Irrespective of whether the drum profile is trihedral or oval/rhomboidal, the first sheet transport drum can be what is known as a skeleton drum or preferably what is known as a blade-surface drum.

In the case of the skeleton drum, the gripper systems are carried by carrying arms, which are disposed along a drum axis in a row at a great distance from one another. Because of the openings or windows in the drum side surfaces, bounded by the drum axis, the carrying arms and the gripper systems, the skeleton drum is typically not able to exert any pneumatic action on the printing-material sheet transported by it.

As opposed to the skeleton drum, the blade-surface drum exerts a pneumatic action on the printing-material sheet transported by it which is similar to the action of a circular piston. The outer contour lines are formed by closed or at least substantially closed side surfaces of the first sheet transport drum which, during the rotation of the first sheet transport drum, act pneumatically as air blades and, in the process, give rise to a back-up of air which supports the rear of the printing-material sheet transported by the first sheet transport drum, or an air cushion which acts in such a way. For this purpose, the side surfaces extend in a closed or at least substantially closed manner along the outer contour lines from one gripper system to the other and, in the axial direction of the first sheet transport drum, from its one to its other drum end. The side surfaces or air blades determining the outer contour lines are preferably sheet guide plates fitted to a drum core.

Apart from the first and the second sheet transport drum, the machine processing the printing-material sheets can further contain a third sheet transport drum, which is disposed immediately after the second sheet transport drum in the sheet transport direction and, together with the second sheet transport drum, forms a turner device for turning the printing-material sheets. The second sheet transport drum can in this case in turn be disposed immediately after the first sheet transport drum. With regard to the one pair of drums (first sheet transport drum/second sheet transport drum), "disposed immediately after" means that the first sheet transport drum is disposed to transfer the printing-material sheets directly to the second sheet transport drum, and the second sheet transport drum is disposed to pick up these printing-material sheets directly from the first sheet transport drum. In an analogous way with respect to the other pair of drums (second sheet transport drum/third sheet transport drum), means that the second sheet transport drum is disposed to transfer the printing-material sheets directly to the third sheet transport drum, and the third sheet transport drum is disposed to pick up the printing-material sheets directly from the second sheet transport drum. Thus, between the first and the third sheet transport drum there is only the second sheet transport drum and no other sheet transport drum. The second sheet transport drum functions as what is known as a storage drum belonging to the turner device, and the third sheet transport drum functions as what is known as a turner drum belonging to the sheet transport device.

The machine processing the printing-material sheets is preferably a sheet-fed press with printing units disposed in-line, in which the first sheet transport drum and the second sheet transport drum are disposed between impression cylinders of the printing units. Each of the printing units can be an offset printing unit or a flexographic printing unit used for varnishing, for example. The printing units disposed in a row that predefines the sheet transport direction and between which the turner device can be located each contain one of the impression cylinders.

Other features which are considered as characteristic for the invention are set forth in the appended claims.

Although the invention is illustrated and described herein as embodied in a sheet transport drum for a machine processing printing-material sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
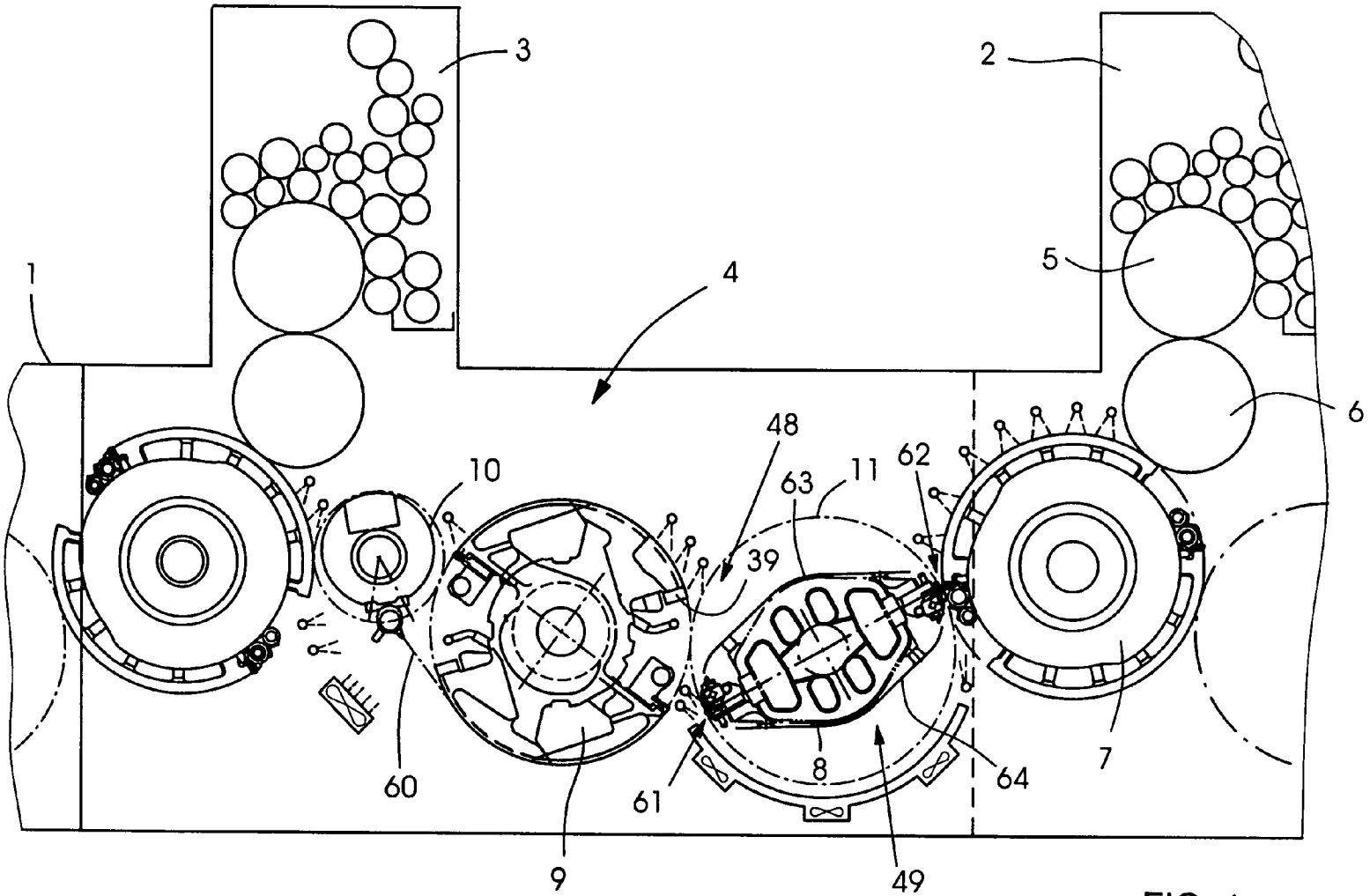
FIG. 1 is a diagrammatic, side-elevational view of a sheet-fed press having a sheet transport drum.

Referring now to the figures of the drawing in detail and first, particularly, to FIG. 1 thereof, there is shown a sheet-fed press 1 of an in-line configuration having a first printing unit 2, a second printing unit 3 following the first printing unit 2 in a sheet transport direction, and a turner device 4 disposed between the two printing units 2, 3 for turning the printing-material sheets to be printed. In accordance with the offset printing principle, each of the two printing units 2, 3 contains a printing form cylinder 5, a blanket cylinder 6 and an impression cylinder 7. The turner device 4 contains a first sheet transport drum 8, which immediately follows the impression cylinder 7 of the first printing unit 2 in a sheet transport direction, a second sheet transport drum 9 and a third sheet transport drum 10. The first sheet transport drum 8 has gripper systems 61, 62 provided to hold the printing-material sheets and disposed diametrically. The gripper systems 61, 62, during the rotation of the first sheet transport drum 8, describe a gripper flight circle 11 whose imaginary diameter is substantially exactly the same size as the outer diameter of the second sheet transport drum 9 and is substantially twice as large as an outer diameter of the printing form cylinder 5. The cross-sectional outer contour of the first sheet transport drum 8 deviates considerably from the circular shape and contains outer contour regions 63, 64 which extend from one gripper system to the other and which are set back from the gripper flight circle 11 in the direction of the drum center, so that within the gripper flight circle 11 there are free spaces 48, 49 located above the outer contour regions. The free spaces 48, 49 make it possible for the sheet trailing edge of the respective printing-material sheet, projecting away from the sheet transport drum on account of the stiffness of the sheet material (board sheets), in its state already gripped at the sheet leading edge by the second sheet transport drum 9 to project or dip into one of the free spaces 48, 49. The aforementioned outer contour regions and free spaces 48, 49 and cylinder channels not occupied by gripper systems are decisive for the substantial deviation of the cross-sectional outer contour from the circular shape. The cross-sectional outer contour of the first sheet transport drum 8 is substantially oval or rhomboidal. As opposed to the first sheet transport drum 8, the second sheet transport drum 9, which is disposed between the first sheet transport drum 8 and the third sheet transport drum 10, has a substantially circular cross-sectional outer contour. The turner device 4 is configured such that it can optionally be changed over from a first operating mode, provided for pure recto printing, into a second operating mode, provided for recto and verso printing, which is illustrated in FIG. 1, and back into the first operating mode again. The third sheet transfer drum 10 has a single gripper system, whose gripper flight circle is substantially exactly as large as the outer diameter of the printing form cylinder 5 and by which the third sheet transport drum 10 grips each printing-material sheet 60 at the sheet leading edge in the first operating mode and at the sheet trailing edge in the second operating mode. Accordingly, in the first operating mode, the turner device 4 transfers the printing-material sheets unturned and, in the second operating mode, turned to the second printing unit 3 and, in the first operating mode, the two printing units 2, 3 print on the same sheet side and, in the second operating mode, print on different sheet sides of each of the printing-material sheets to be printed.

Figure 2:
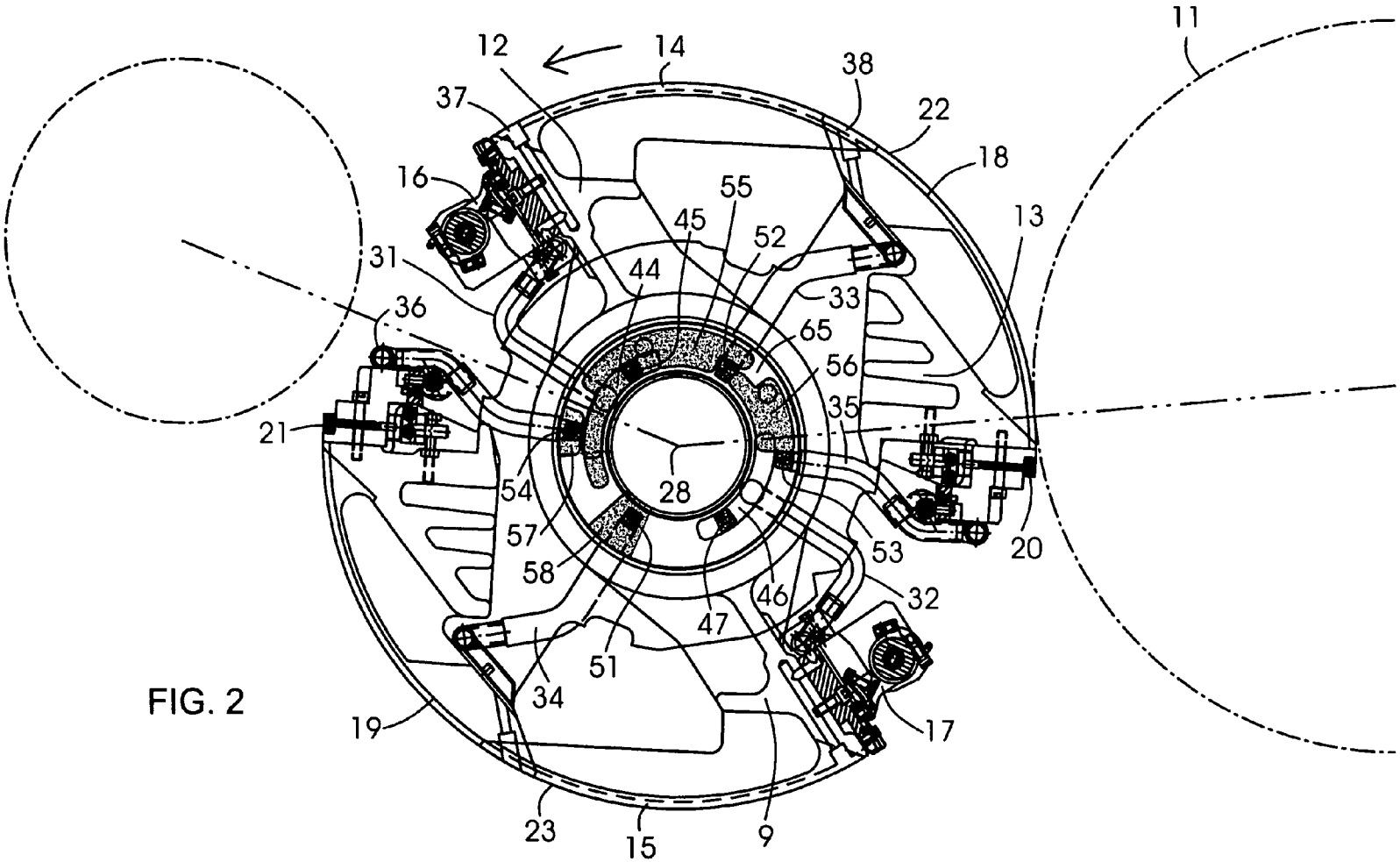
FIG. 2 is an enlarged, side-elevational view showing the sheet transport drum from FIG. 1, in which a rotary valve can be seen.
Figure 3:
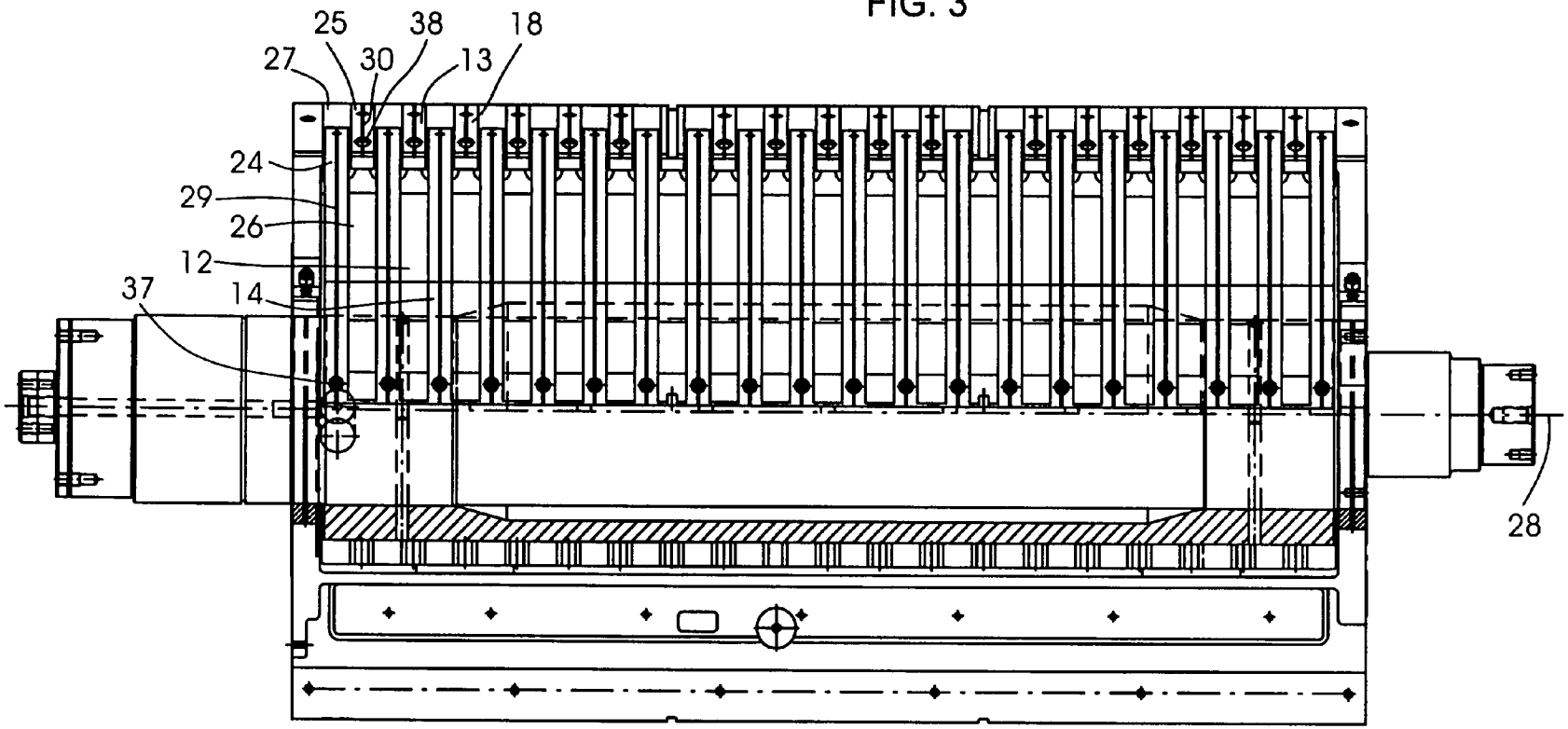
FIG. 3 is a plan view of the sheet transport drum from FIG. 2, from which comb segments can be seen.
Figure 4:
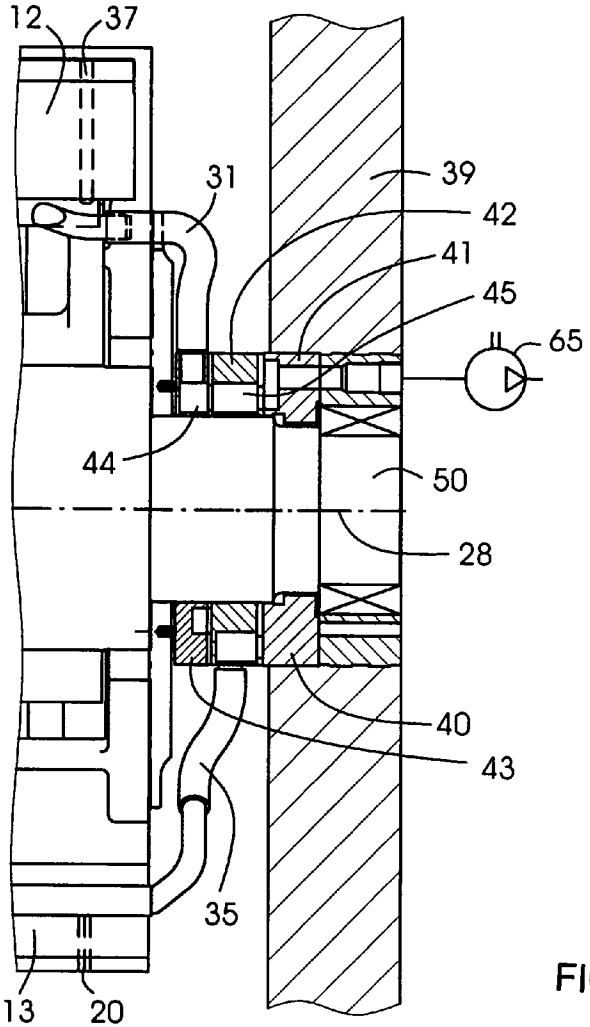
FIG. 4 is a plan view of the rotary valve from FIG. 2, from which the three-part valve configuration can be seen.

FIGS. 2 and 3 reveal the subdivision of the second sheet transport drum 9 into a first half-drum 12 and a second half-drum 13. The first half-drum 12 contains a first comb segment 14, a second comb segment 15 and gripper systems 16, 17 which are provided to clamp in the printing-material sheets at their sheet leading edges and of which each one is disposed to immediately precede another of the two comb segments 14, 15. The second half-drum 13 contains a third comb segment 18, a fourth comb segment 19 and rows of suction nozzles (known as trailing edge suckers) 20, 21, which are provided to suck on the printing-material sheets close to their sheet trailing edges and of which each one is disposed to immediately follow another of the two comb segments 18, 19. The first comb segment 14, together with the third comb segment 18, forms a first sheet support surface 22, and the second comb segment 15, together with the fourth comb segment 19, forms a second sheet support surface 23. The two sheet support surfaces 22, 23, provided for the support of printing-material sheets during their transport by the second sheet transport drum 9 from the first sheet transport drum 8 to the third sheet transport drum 10, are disposed diametrically and are configured to be variable in terms of sheet format length in the manner to be explained below. The first comb segment 14 and the third comb segment 18 are in each case provided with segment prongs 24, 25 at their mutually facing segment edges, the prongs engaging in prong interspaces 26, 27 located between the segment prongs of the respective other of the two comb segments 14, 18. In exactly the same way, the trailing segment contour of the second comb segment 15 and the leading segment contour of the fourth comb segment 19 are of pronged design, so that these two segment contours also intermesh. For the print-job-specific adaptation of the second sheet transport drum 9 to sheet format lengths of the printing-material sheets which are different from print job to print job, the first half-drum 12 is mounted such that it can be rotated relative to the second half-drum 13 about an axis of rotation 28. For the purpose of shortening the sheet support surfaces 22, 23 and equally large spacings which are present between the gripper system 16 and the row of suction nozzles 20 and also between the gripper system 17 and the row of suction nozzles 21, the first half-drum 12 is rotated toward the second half-drum 13, that is to say in the clockwise direction with respect to FIG. 2. During this rotation, used for adaptation to a shorter sheet format length, the segment prongs 24, 25 are pushed more deeply into the prong interspaces 26, 27. During lengthening of the sheet support surfaces 22, 23, used for adaptation to a longer sheet format length, and therefore of the aforesaid spacings between the gripper systems 16, 17 and the rows of suction nozzles 20, 21, the first half-drum 12 is rotated away from the second half-drum 13, that is to say in the counterclockwise direction with respect to FIG. 2. During the last-named rotation, the segment prongs 24, 25 are pulled right out of the prong interspaces 26, 27 to an extent corresponding to the format length difference which exists between the two printing-material sheet formats which have different lengths and therefore make the adaptation necessary. The segment prongs 24, 25 of each of the four comb segments 14, 15, 18, 19 are provided on the outside with pneumatic or suction grooves 29, 30 to which vacuum can be applied cyclically in order to suck on the printing-material sheets, as illustrated in FIG. 3 using the example of the first comb segment 14 and the third comb segment 18. The suction grooves 29, 30 are elongated notches or slots and therefore not circular suction holes. On account of the mutually identical formation of the first comb segment 14 and of the second comb segment 15, and the likewise mutually identical formation of the third comb segment 18 and the fourth comb segment 19, the detailed description of the suction grooves 29, 30, given below using the example of the comb segments 14, 18, applies in the figurative sense also to the two other comb segments 15, 19. In each case one of the suction grooves 29, 30 is introduced approximately centrally into each of the segment prongs 24, 25. The suction grooves 29, 30 run parallel to one another and along the segment prongs 24, 25 and thus in the drum circumferential direction. Each of the suction grooves 29, 30 has a substantially U-shaped groove cross-sectional inner contour, which is pneumatically open, that is to say is air-permeable, on the drum circumferential side. Each of the suction grooves 29, 30 is unprotectedly open in its illustrated design and, instead, could also be covered by a perforated plate disposed above the respective suction groove or a protective cover of an air-permeable material, for example a textile (fabric), fibrous (nonwoven) or mesh-like (gauze) material disposed in the same way. Such a protective cover can function as a filter and prevent the penetration, for example, of contaminants (paper dust) originating from the printing-material sheets into the suction groove and permit only the filtered suction air to penetrate. The aforementioned materials could also be used with regard to bringing about or reinforcing a restrictive effect of the suction grooves 29, 30. Likewise, an insert functioning as a dust filter and/or restrictor could be inserted into the respective suction groove 29, 30. At least the suction grooves 30 of the two comb segments 18, 19 which trail in the drum rotational direction during printing operation, but preferably the suction grooves 29, 30 of all four comb segments 14, 15, 18, 19, are finished geometrically in such a way that the suction grooves—for example on account of their narrowness and/or depth—act in a manner similar to what are known as restrictor nozzles. Each of the suction grooves (restrictor grooves) 29, 30 restricting the vacuum thus acts in the following way: not only in the case of complete coverage but also in the case of only incomplete coverage of the groove opening of the corresponding suction groove on the drum circumference side by the printing-material sheet which rests on the segment prong having the aforesaid suction groove above precisely this suction groove, the vacuum (negative pressure) prevailing in the suction groove is maintained. The section of the groove opening that is free and open to the environment in the event of the partial coverage by the printing-material sheet can thus advantageously not cause any collapse of the vacuum prevailing in the suction groove. In the event that one of the suction grooves 29, 30 is not covered at all, that is to say not even partially, by the printing-material sheet, for example because the corresponding suction groove is located outside the sheet format width of the printing-material sheet, the leakage air stream (air leakage) flowing into the fully uncovered suction groove is at least reduced to a tolerable extent by the groove-restrictor geometry. Furthermore, the second sheet transport drum 9 contains a first 31, a second 32, a third 33, a fourth 34, a fifth 35 and a sixth 36 vacuum collecting line. In each of the suction grooves 29, 30, close to their leading groove end, there opens a vacuum connection 37, 38, via which the negative suction pressure (vacuum) prevailing in the respective suction groove 29, 30 is applied to the suction groove 29, 30. The vacuum connections 37 of all the suction grooves 29 of the first comb segment 14 branch off from the common, first vacuum collecting line 31, and the vacuum connections 38 of all the suction grooves 30 of the third comb segment 18 branch off from the common, third vacuum collecting line 33. In functional terms, the second vacuum collecting line 32 of the second comb segment 15 corresponds to the first vacuum collecting line 31, and the fourth vacuum collecting line 34 of the fourth comb segment 19 corresponds to the third vacuum collecting line 33. The row of suction nozzles 20 of the third comb segment 18 is connected pneumatically to the fifth vacuum collecting line 35, and the row of suction nozzles 21 of the fourth comb segment 19 is connected pneumatically to the sixth vacuum collecting line 36. Each of the vacuum collecting lines 31 to 36 is formed in many parts and contains a line piece which is parallel to the drum axis, from which the respective vacuum loads (rows of suction nozzles 20, 21 and vacuum connections 37, 38) branch off, and a substantially radially oriented line piece, which extends toward a rotary valve 40, in the form of a hose or pipe. The rotary valve 40 is disposed in axial alignment with the second sheet transport drum 9 and is formed in three parts in a sandwich construction, as can best be seen from FIG. 4. The rotary valve 40 contains a first valve part 41 fitted firmly to a machine frame (side wall) 39 so as not to rotate, a third valve part 43 connected firmly so as to rotate with the second sheet transport drum 9, and a second valve part 42 inserted between the two valve parts 41, 43 already mentioned. Connected to the first valve part 41 is a vacuum source 65, which applies the vacuum to the pneumatic grooves 29, 30 and rows of suction nozzles 20, 21. Through the three respectively annularly formed valve parts 41 to 43 there extends an axle journal 50 of the second sheet transport drum 9, which is mounted by an antifriction bearing such that it can rotate in the machine frame 39. The two movable valve parts 42 and 43 fitted to the second sheet transport drum 9 are assigned to different half-drums 12, 13. The second valve part 42 is firmly fitted so as to rotate with the second half-drum 13, and the third valve part 43 is firmly fitted so as to rotate with the first half-drum 12. Therefore, with each rotation of the first half-drum 12 relative to the second half-drum 13 through a specific rotational angle, used to adapt to the sheet format length, a rotation of the third valve part 43 by the same rotational angle relative to the second valve part 42 is also necessarily effected. This rotation of the one, namely the third, valve part 43 relative to the other, namely the second, valve part 42 in turn results in a first coupling chamber 44 being adjusted relative to a first passage hole 45, and a second coupling chamber 46 being adjusted relative to a second passage hole 47, from the first coupling position, illustrated in FIG. 2 and corresponding to the maximum sheet format length, to a second coupling position, not specifically illustrated and corresponding to the minimum sheet format length, or a third coupling position located arbitrarily between the aforementioned two coupling positions. The first vacuum collecting line 31 opens into the first coupling chamber 44, and the second vacuum collecting line 32 opens into the second coupling chamber 46. The coupling chambers 44, 46 are introduced into the third valve part 43 diametrically, that is to say angularly offset by 180° with respect to each other, and are open toward the second valve part 42 bearing on the third valve part 43. In each of the aforementioned coupling positions, the passage holes 45, 47 overlap the coupling chambers 44, 46, so that the suction air can flow from the coupling chambers 44, 46 into the passage holes 45, 47. The second valve part 42 and the third valve part 43 thus together form a pneumatic coupling whose rotational angle can be adjusted steplessly corresponding to the stepless sheet format length adaptation and which is integrated in the rotary valve 40. Advantageous with regard to the constructional compactness is the multifunctional use of the second valve part 42 first for the purpose of adjusting the pneumatic coupling and second for the purpose of the periodic vacuum control (vacuum cycling) carried out in interaction with the first valve part 41.

Apart from the passage holes 45, 47, which function as air control holes and together form a first pair of holes, in addition a first air control hole 51 and a second air control hole 52, which together form a second pair of holes, and a third pair of holes formed of a third air control hole 53 and a fourth air control hole 54 are introduced into the second valve part 42. The two holes of each of the pairs of holes are offset in relation to each other by an angle amounting to 180° and are thus disposed diametrically opposite each other. The three pairs of holes are disposed to be offset in relation to one another by specific center angles. The four holes 45, 47, 51, 52 are disposed one after another on one and the same first hole flight circle, which is closer to the center than a second hole flight circle, on which the other two holes 53, 54 are disposed one after the other. The hole flight circles are imaginary, concentric movement paths, along which the holes 45, 47, 51 to 54 move during the rotation of the second valve part 42. Each of the air control holes 51 to 54 is formed of a blind hole and a transverse bore opening laterally into the latter and is closed in the direction of the third valve part 43. The transverse bores are oriented in the radial directions of the second valve part 42, open into the circumferential surface of the latter and are used for connecting the vacuum collecting lines 33 to 36. Each of the vacuum collecting lines 33, 34 is connected to another of the air control holes 51, 52, and each of the vacuum collecting lines 35, 36 is connected to another of the air control holes 53, 54.

Introduced into the first valve part 41 are a first air control groove 55, a second air control groove 56, which is shorter in the circumferential direction than the first air control groove 55, a first venting opening 57 and a second venting opening 58, which is longer in the radial direction than the first venting opening 57. The first air control groove 55 has a first groove end, which extends only beyond the inner, first hole flight circle, and an opposite, second groove end, which extends only over the outer, second hole flight circle, and is thus tapered radially at both ends. In addition, the first air control groove 55 has a groove central section located between its groove ends, that extends radially beyond both the first and beyond the second hole flight circle. The second air control groove 56 has a groove end facing the second groove end of the first air control groove 55, which is likewise tapered radially and extends only beyond the first hole flight circle placed closer to the axis of rotation 28, and a groove section which adjoins the last-named groove end and which extends beyond both hole flight circles. Between the air control grooves 55, 56 there is thus a land 59, which extends beyond both hole flight circles and is kept so narrow that the second groove end of the first air control groove 55 and the groove end of the second air control groove 56, facing the former, overlap slightly. The first venting opening 57 extends in the radial direction only beyond the outer, second hole flight circle, that is to say not beyond the first hole flight circle, and in the circumferential direction only within a center angle range of the rotary valve 40 occupied by the first groove end of the first air control groove 55. The second venting opening 58 is disposed between the second air control groove 56 and the first groove end of the first air control groove 55 and extends beyond both hole flight circles. During rotation of the second valve part 42, the four inner holes 45, 47, 51, 52 thus do not overlap with the first venting opening 57 and the second groove end at all, and the two outer holes 53, 54 do not overlap with the first groove end at all. However, during rotation of the second valve part 42, the four inner holes 45, 47, 51, 52 successively overlap or co-operate periodically for the purpose of the passage of air with the second air control groove 56, including its tapered groove end, the first air control groove 55, including its first groove end, and the second venting opening 58. In addition, during the rotation of the second valve part 42, the two outer holes 53, 54 from time to time overlap, and therefore make an air-carrying connection with, the second air control groove 56, the first air control groove 55, including its second groove end, and the two venting openings 57, 58.

The principle according to which the passage holes and air control holes, the venting openings and the air control grooves are dimensioned and placed may readily be transferred from the double-sized sheet transport drum 9 illustrated, having two gripper systems, to a sheet transport drum that is three times larger having three gripper systems, and best becomes clear from the following functional description.

Figure 5A:
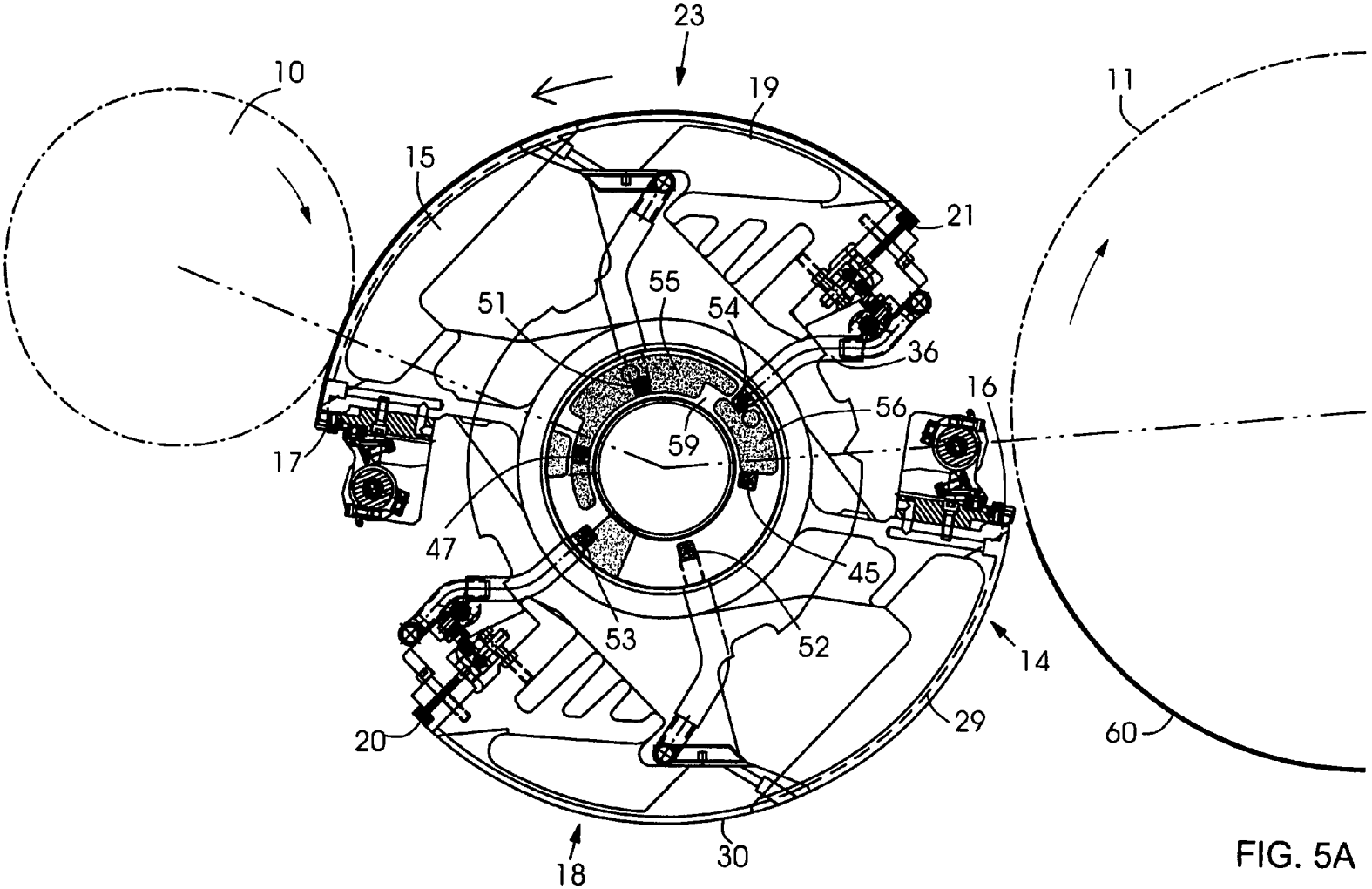
FIGS. 5A to 5H are side-elevational view showing a sequence of various rotary positions of the sheet transport drum and of the rotary valve from FIG. 2.

In FIG. 5A, the second sheet transport drum 9 and its rotary valve 40 are illustrated in a rotary position in which the transfer of the printing-material sheet 60 from the first sheet transport drum 8 by the gripper system 16 is immediately imminent. In this rotational angle position, neither the first passage hole 45 nor the second air control hole 52, nor the third air control hole 53 overlaps either of the two air control grooves 55, 56. As a result, the vacuum produced by the vacuum source 65 and applied to the rotary valve 40 can reach neither the suction grooves 29 of the leading, first comb segment 14 nor the suction grooves 30 of the trailing, third comb segment 18 nor the row of suction nozzles 21.

It can be seen that the second air control groove 56 fits exactly between the first passage hole 45 and the fourth air control hole 54. In the rotary position according to FIG. 5A, a vacuum which is produced in the sixth vacuum collecting line 36 via the second air control groove 56 and the fourth air control hole 54 and which is applied to the row of suction nozzles 21 before this rotary position is reached is maintained, although the connection between the row of suction nozzles 21 and the vacuum source is briefly interrupted. The maintenance of the vacuum is ensured since the fourth air control hole 54 is located over the land 59 and is kept sealed off or closed by the latter. The second passage hole 47 and the first air control hole 51 are at this time simultaneously co-operatively opposite the first air control groove 55, so that, via the latter, the vacuum is present both in the pneumatic or suction grooves of the second comb segment 15 and in the pneumatic or suction grooves of the fourth comb segment 19.

A printing-material sheet resting on the second sheet support surface and held at its leading edge in the gripper system 17 and led by the latter past the third sheet transport drum 10 is thus fixed pneumatically virtually over its entire sheet format length, by the printing-material sheet being sucked on simultaneously by the suction grooves of the second comb segment 15, the suction grooves of the fourth comb segment 19 and the row of suction nozzles 21. The entry of the first passage hole 45, to which the first sheet support surface 22 is connected, into the region of the second air control groove 56 cannot have a disruptive effect on the vacuum of the second sheet support surface 23 since, at the time of this entry, the holes 47, 51 and 54 are already located outside the range of the second air control groove 56.

In FIGS. 5A to 5H, the second sheet transport drum 9 is shown in its setting suitable for the maximum sheet format length, in which the two comb segments 14, 15 and also the two comb segments 15, 19 are in each case pulled apart to the greatest extent possible. In addition, in FIGS. 5A to 5H, an arrow indicates the operational direction of rotation (in the counterclockwise direction here) of the second sheet transport drum 9, including the second valve part 42 and the third valve part 43.

Figure 5B:
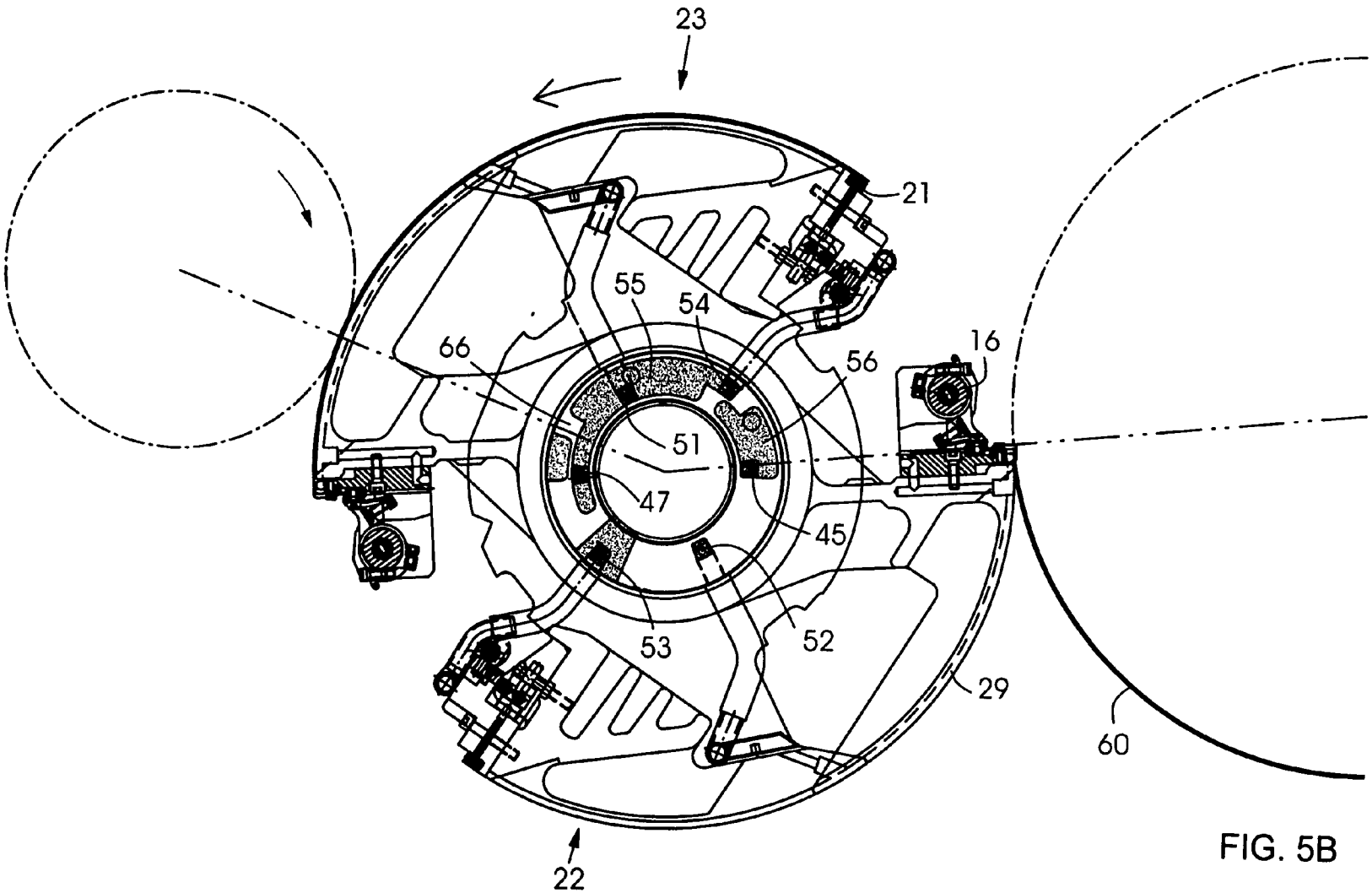

In FIG. 5B, the second sheet transport drum 9, including its second valve part 42, is shown in a rotational position changed by a few degrees of arc as compared with FIG. 5A, in which the gripper system 16 is at a sheet transfer point and the transfer of the printing-material sheet 60 from the gripper system 61 of the first sheet transport drum 8 to the gripper system 16 of the second sheet transport drum 9 is carried out. In this changed rotational position, the first passage hole 45 is already located in the second air control groove 56, specifically at the start of the latter, and the holes 52, 53 are still outside the air control grooves 55, 56. Therefore, in this rotational angle position, of the three vacuum loads (row of suction grooves 29, row of suction grooves 30, row of suction nozzles 20) of the first sheet support surface 22, only one vacuum load, namely the suction grooves 29, has the vacuum applied to it. During the application of this vacuum, the suction air flows from the suction grooves 29 via the vacuum collecting line 31 into the first coupling chamber 44, from the first coupling chamber 44 into the first passage hole 45, from the latter into the second air control groove 56 and from the latter into the vacuum source 65. In the rotational angle position illustrated in FIG. 5B, although the suction grooves 29 of the first comb segment 14 are not yet covered at all, that is to say not even partially, by the printing-material sheet 60 to be picked up, nevertheless, on account of the restrictive geometry of the suction grooves 29 which are still uncovered and thus subject to a leakage air flow, a vacuum (that is to say a negative pressure) builds up which, in the course of the further drum rotation, causes the printing-material sheet 60 to adhere firmly to the suction grooves 29.

With regard to the application of vacuum to the second sheet support surface 23, the rotational position according to FIG. 5B differs from that according to FIG. 5A only in the fact that not only the holes 47, 51 but now also the fourth air control hole 54 are connected to the vacuum source via the first air control groove 55. Accordingly, in the rotational position according to FIG. 5B, there is applied to the row of suction nozzles 21 a vacuum that is produced actively instead of one which is only maintained passively (as in the rotational position according to FIG. 5A).

Figure 5C:
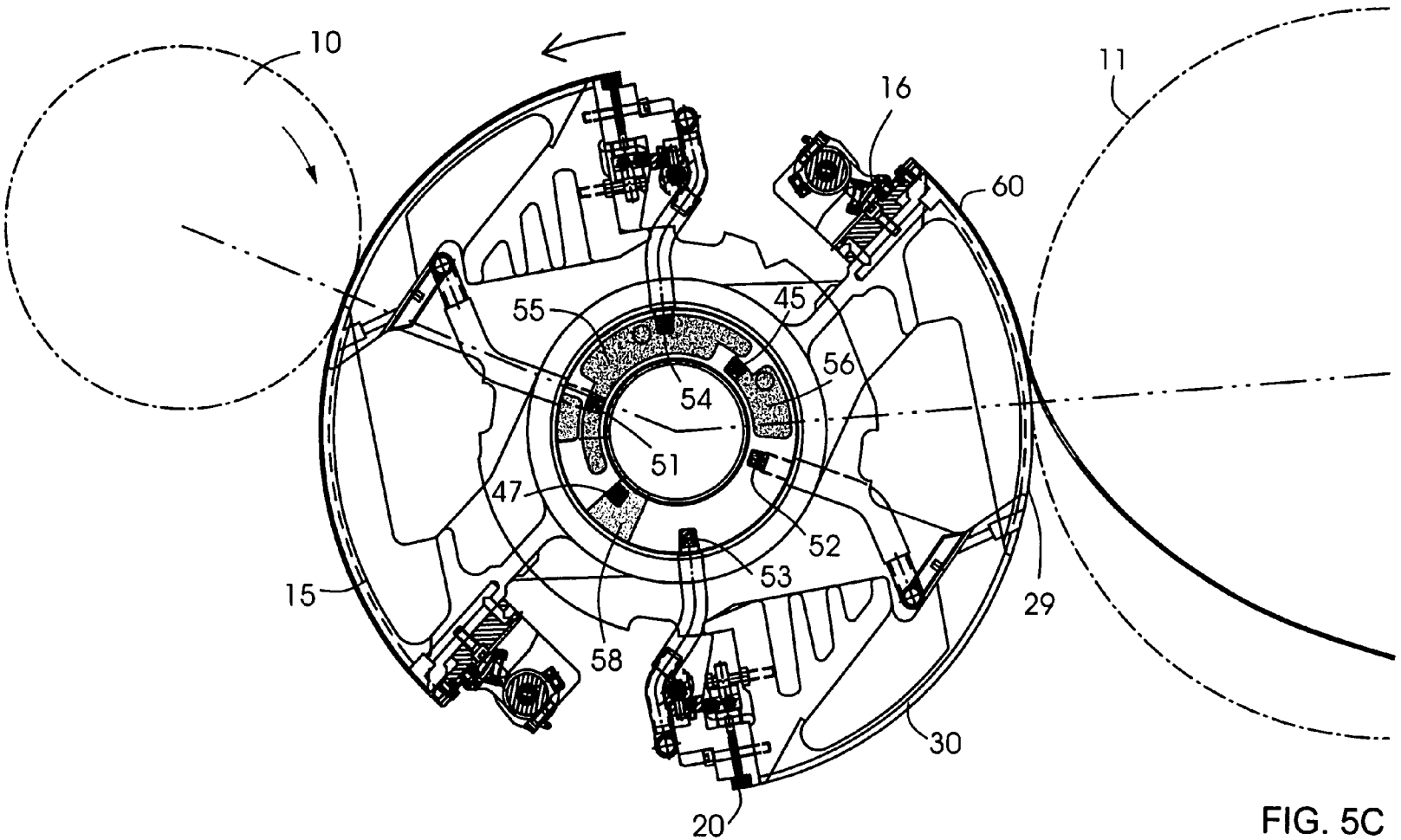

FIG. 5C shows a rotational angle position in which, although the first passage hole 45 has already reached the end of the second air control groove 56, it has not yet left the latter, and the printing-material sheet 60 held at its sheet leading edge in the gripper system 16 covers the suction grooves 29 in their suction-groove section that has already run past the sheet transfer point of the sheet transport drums 8, 9, but not yet in the remaining suction-groove section located before the sheet transfer point. In the suction-groove section that has run past the sheet transfer point, there prevails a vacuum that is sufficiently high to keep the printing-material sheet 60 in close contact with the first comb segment 14. FIG. 5C also reveals that the sheet trailing edge of the printing-material sheet 60 dips under the gripper flight circle 11 of the first sheet transport drum 8, and that the holes 52, 53 have not yet reached the second air control groove 56, so that the suction grooves 30 and the row of suction nozzles 20 are still isolated from the vacuum in the first valve part 41 and are thus inactive.

In the rotational position according to FIG. 5C, the second comb segment 15 has already passed the third sheet transport drum 10 and the suction grooves of the second comb segment 15 are vented by these suction grooves being short-circuited to the environment via the second venting opening 58 and the second passage hole 47 which overlaps the second venting opening 58 at this time, so that the vacuum collapses in the last-named suction grooves. During this, the holes 51, 54 are still opposite the first air control groove 55.

Figure 5D:
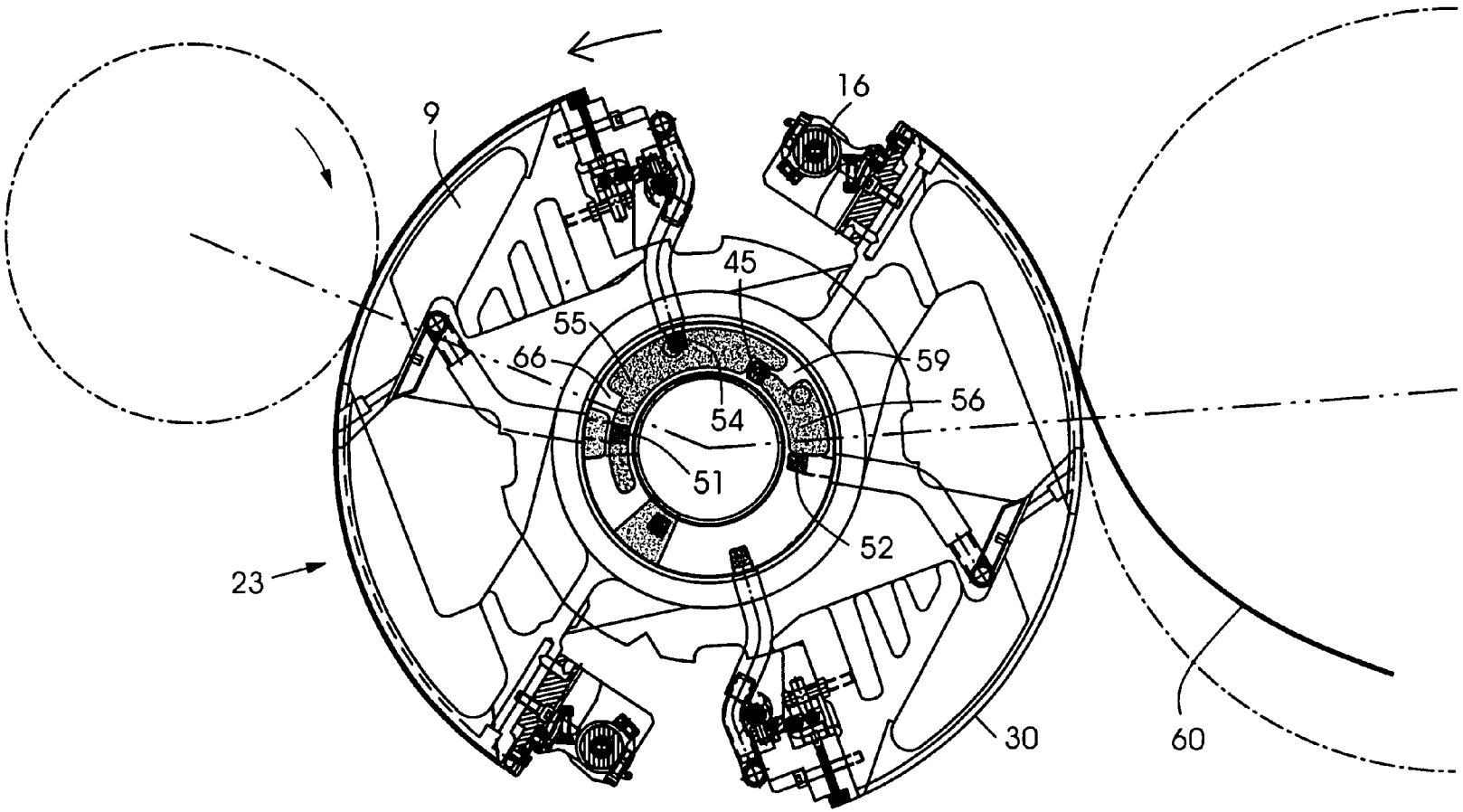

In the rotational position according to FIG. 5D, rotated somewhat further as compared with FIG. 5C, the first passage hole 45 is located in the region of the land 59 and thus between the air control grooves 55, 56, and the second air control hole 52 is located immediately before its entry to the second air control groove 56. The configuration selected ensures that, at the time at which the second air control hole 52 enters the region of the second air control groove 56, the first passage hole 45 is already located outside the region of the second air control groove 56. The evacuation of the suction grooves 30 via the second air control hole 52, which begins at this time, can thus not cause any air pressure fluctuations or disruptions to the vacuum in the first passage hole 45 and the suction grooves 30. The evacuation which begins cannot cause any disruption to the vacuum in the vacuum loads of the second sheet support surface 23 either since, at the aforesaid time, the holes 51, 54 are not opposite or making an air-carrying connection to the second air control groove 56, via which the evacuation takes place, but instead are opposite the first air control groove 55. In the rotational angle position corresponding to FIG. 5D, the first passage hole 45 and the suction grooves 30 connected thereto are certainly briefly isolated from the vacuum source 65, but the first passage hole 45 is kept tightly closed by the land 59 of the first valve part 41 on its side facing the first valve part 41, so that, within the short time interval, the negative pressure prevailing from the suction grooves 30 as far as the first passage hole 45 is stably held. It can be seen that the second air control groove 56 fits between the first passage hole 45 and the second air control hole 52.

Figure 5E:
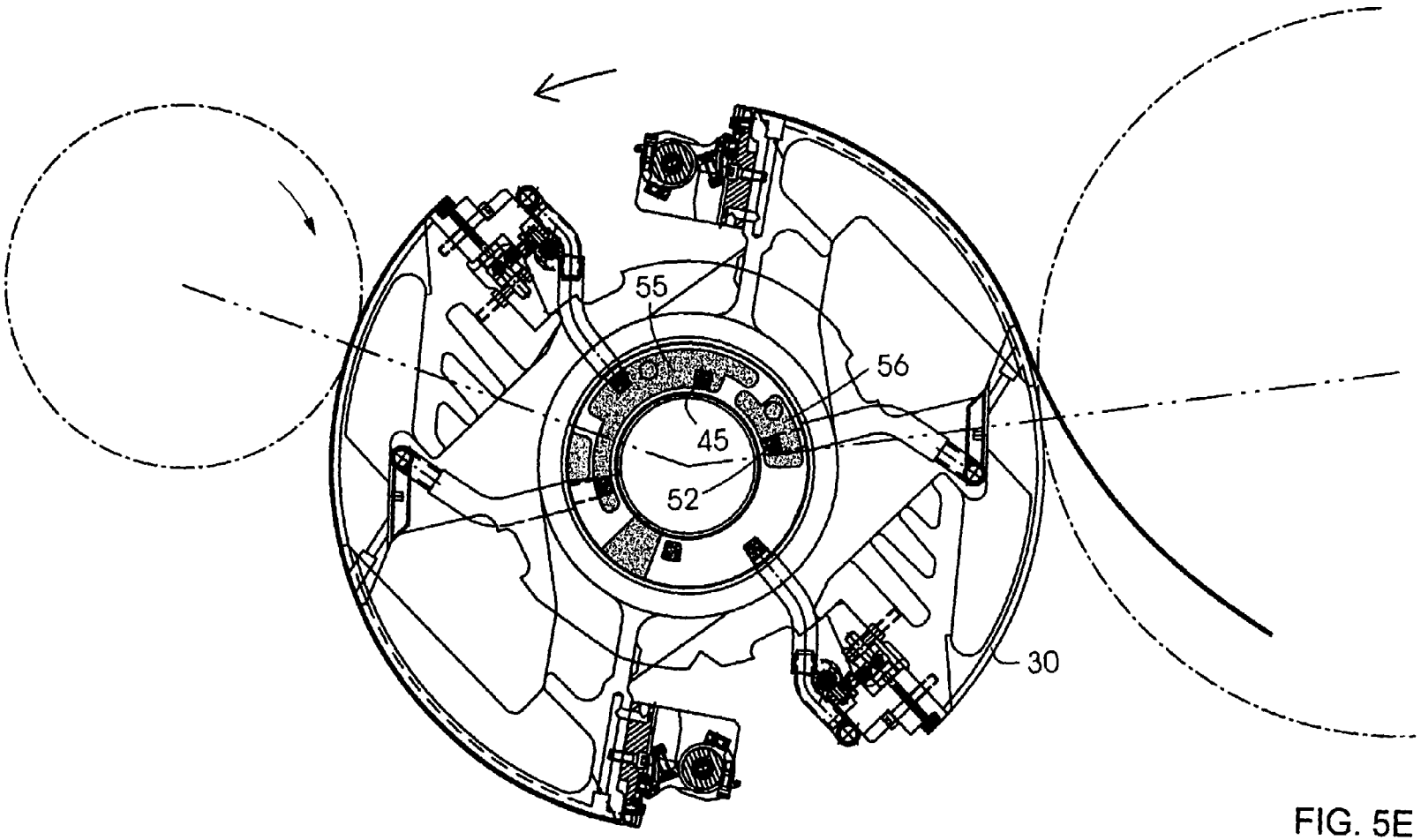

The rotational angle position according to FIG. 5D is followed by the rotational angle position according to FIG. 5E, in which the first passage hole 45 has left the region of the land 59 again and has entered the region of the first air control groove 55, and in which the second air control hole 52 has also already entered the region of the second air control groove 56. In the last-named rotational angle position, each of the holes 45, 52 therefore co-operatively overlaps another of the control grooves 55, 56, so that the suction grooves 29 of the first comb segment 14 are connected to the vacuum source 65 via a different pair containing air control hole/air control groove than the suction grooves of the third comb segment 18.

Figure 5F:
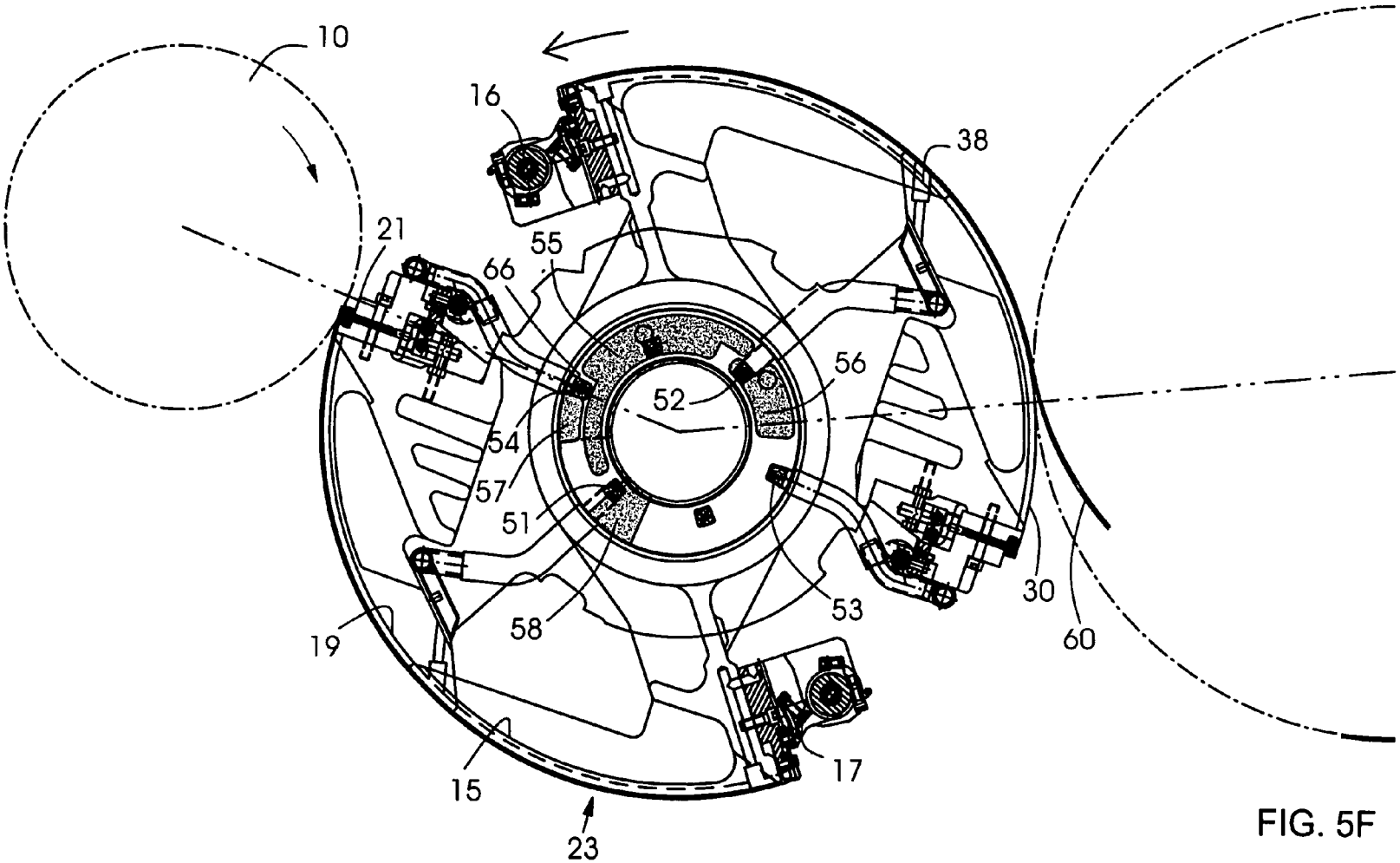

From the last-described rotational angle position, the second sheet transport drum 9 and second valve part 42 pass into a rotational angle position which corresponds to FIG. 5F, in which the second air control hole 52 overlaps the tapered groove end of the second air control groove 56. In this rotational angle position, only the front suction-groove sections of the suction grooves 30 which have already run past the common sheet transfer point of the sheet transfer drums 8, 9 are covered by the printing-material sheet 60 resting tautly on them, and the rear suction-groove sections of the suction grooves 30 which have not yet run past this sheet transfer point are still uncovered by the printing-material sheet 60, whose sheet trailing edge projects away from the second sheet transport drum 9, so that leakage air can flow into the rear suction-groove sections. Although the suction grooves 30 are thus only partially covered by the printing-material sheet 60 and are still open to the environment in the region of their rear suction-groove sections, in the subregion of the suction grooves 30 already covered by the printing-material sheet 60 there prevails a negative pressure which is sufficiently high to keep the printing-material sheet 60 taut and smooth on the circumferential surface of the third comb segment 18 in the region of the front suction-groove sections. The very low leakage air volume sucked into the subregion of the suction grooves 30 that is still uncovered by the printing-material sheet 60 exerts a sucking action on the projecting sheet trailing edge. On account of this suction action, the printing-material sheet 60 gradually comes into contact with the suction grooves 30, even in the region of the rear suction-groove sections, so that the printing-material sheet 60 also remains adhering to the third comb segment 18 in the region of the rear suction-groove sections.

In the rotational position according to FIG. 5F, the third sheet transport drum 10 uses its non-illustrated gripper system to grip the sheet trailing edge of the printing-material sheet resting on the second sheet support surface 23. Shortly before or during this, the sheet leading edge of the printing-material sheet is released by the gripper system 17 and venting or cancellation of the application of vacuum to the suction grooves of the fourth comb segment 19 takes place, since the first air control hole 51 enters the region of the second venting opening 58, and the last-named suction grooves are thus connected to the environment and the ambient air pressure prevailing in the latter. At the time at which the first air control hole 51 enters the region of the second venting opening 58, the fourth air control hole 54 is located between the first air control groove 55 and the first venting opening 57 and overlaps a land 66, which seals off the fourth air control hole 54 and, as a result, maintains the vacuum in the row of suction nozzles 21 passively until the gripper system of the third sheet transport drum 10 has securely gripped the sheet trailing edge.

Figure 5G:
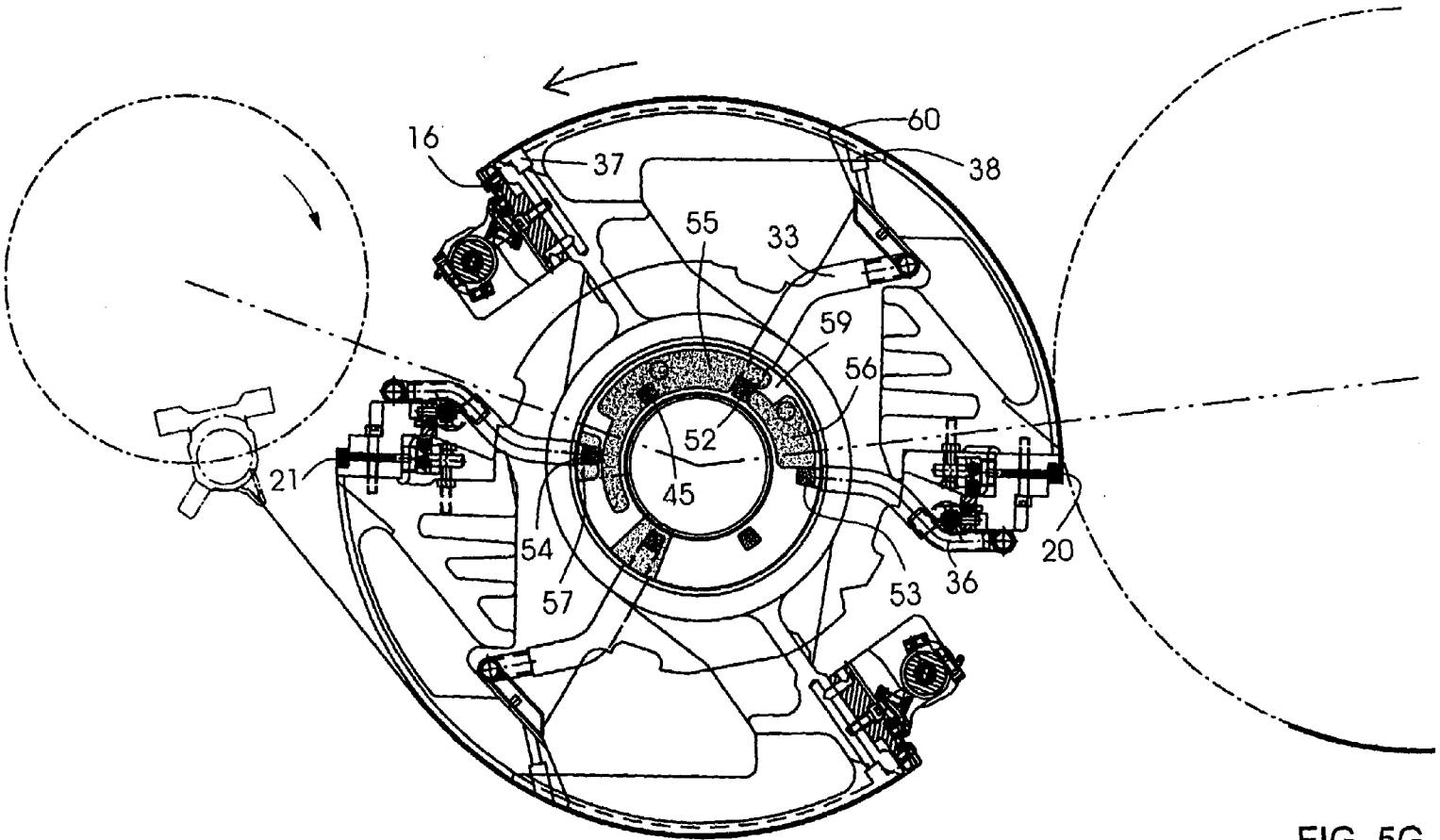

FIG. 5G shows a rotational angle position which follows the rotational angle position illustrated in FIG. 5F, in which the third air control hole 53 is located immediately before its entry to the region of the second air control groove 56, and in which the second air control hole 52 is located between the air control grooves 55, 56 and in the state sealed off by the land 59 covering the second air control hole 52 at this time. This makes it clear that the length of the second air control groove 56 is such that always only one of the two air control holes 52, 53 can make an air-carrying connection to the second air control groove 56. At the time at which the third air control hole 53 enters the region of the second air control groove 56, neither the second air control hole 52 nor the first passage hole 45, which at this time is still located in the region of the first air control groove 55, overlaps the second air control groove 56. Consequently, the evacuation of the air from the row of suction nozzles 20 and the vacuum collecting line 36 via the third air control hole 53 and the second air control groove 56 by the vacuum source 65, which begins with the entry of the third air control hole 53 into the region of the second air control groove 56, cannot lead to vacuum fluctuations in the suction grooves 29 of the first comb segment 14 via the first passage hole 45 nor to an undesired rise in the air pressure in the suction grooves 30 of the third comb segment 18 via the second air control hole 52. In the situation illustrated in FIG. 5G, in which the second air control hole 52 already no longer overlaps the second air control groove 56 and does not yet overlap the first air control groove 55, and in which the opening of the second air control hole 52, facing the land 59 of the first valve part 41, is kept closed by the land 59, the vacuum in the vacuum chamber formed jointly by the suction grooves 30, the vacuum connection 38, the vacuum collecting line 33 and the second air control hole 52 is kept substantially constant, although the pneumatic connection between this vacuum chamber and the vacuum source 65 is interrupted briefly. In addition, the vacuum prevailing in the region located between the suction grooves 29 and the first passage hole 45 remains undisturbed by the entry of the third air control hole 53 into the region of the second air control groove 56, since, at the time of this entry, the first passage hole 45 is interacting with a different air control groove than the third air control hole 53.

From FIG. 5G it can further be seen that the fourth air control hole 54 is now opposite the first venting opening 57 and thus the venting of the row of suction nozzles 21 takes place, as a result of which venting the sheet trailing edge of the printing-material sheet is released or set free by the row of suction nozzles 21.

Figure 5H:
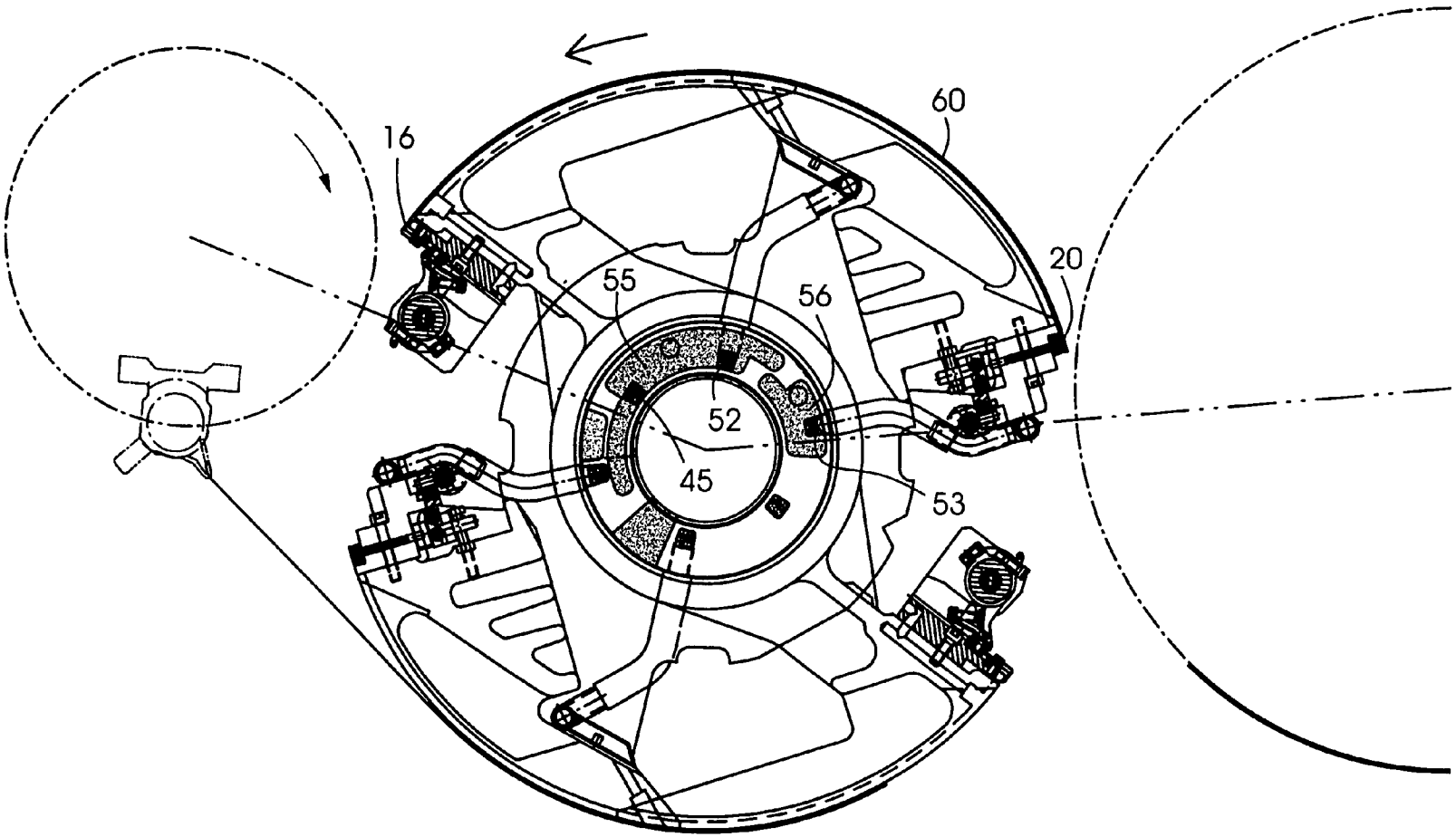

In the following rotational angle position according to FIG. 5H, the third air control hole 53 co-operatively overlaps the second air control groove 56 and, at the same time, the holes 45, 52 co-operatively overlap the first air control groove 55, so that the suction grooves 29 of the first comb segment 14 and the suction grooves 30 of the third comb segment 18 have the vacuum applied to them via different air control holes (first passage hole 45, second air control hole 52) but via one and the same air control groove, namely the first air control groove 55.

According to a constructional and functional modification that is not specifically illustrated, it is possible for the pneumatic grooves 29, 30 to be ventilated actively via the venting openings 57, 58 by a compressed-air producer (positive pressure source), which is connected to the rotary valve 40. Such active ventilation would have the advantage that, as a result, the pneumatic grooves 57, 58 and their air feeding system would be cleaned and, in the process, for example paper particles would be blown out of the second sheet transport drum 9.

We claim:

1. A sheet transport drum for a machine processing printing-material sheets, the sheet transport drum comprising:

at least one sheet support surface having pneumatic grooves formed therein, said sheet support surface having a first comb segment with segment prongs and a second comb segment with segment prongs, said first comb segment and said second comb segment intermeshing with one another, said pneumatic grooves being introduced into said segment prongs of at least one of said first and second comb segments.

2. The sheet transport drum according to claim 1, wherein said pneumatic grooves are introduced both into said segment prongs of said first comb segment and into said segment prongs of said second comb segment.

3. The sheet transport drum according to claim 1, wherein each of said pneumatic grooves is formed as a suction and restrictor groove, to which a vacuum sucking on a respective printing-material sheet can be applied and which is profiled such that the vacuum is maintained, at least to an extent which is sufficient to suck on the respective printing-material sheet, even given incomplete coverage of said suction and restrictor groove by the respective printing-material sheet.

4. The sheet transport drum according to claim 1, further comprising a rotary valve connected to said pneumatic grooves, said rotary valve applying air cyclically to said pneumatic grooves in dependence on rotational angle positions assumed by the sheet transport drum during a rotation of the sheet transport drum.

5. The sheet transport drum according to claim 4, wherein said rotary valve has a first valve part, a second valve part, and a third valve part, and said first, second and third valve parts are disposed so as to be aligned axially and on one another in a sandwich construction.

6. The sheet transport drum according to claim 5, wherein said first valve part and said third valve part form an air outlet and an air inlet of said rotary valve, and said second valve part forms an air passage of said rotary valve.

7. The sheet transport drum according to claim 5, wherein said third valve part is mounted such that said third valve part can be rotated relative to said second valve part during a sheet format changeover of the sheet transport drum, and said second valve part is mounted such that said second valve part can be rotated relative to said first valve part during each drum revolution.

8. The sheet transport drum according to claim 5, wherein said second valve part has a first air control hole and a second air control hole formed therein, said pneumatic grooves of said first comb segment are connected to said first air control hole, and said pneumatic grooves of said second comb segment are connected to said second air control hole, and said first air control hole is disposed offset by a central angle relative to said second air control hole.

9. The sheet transport drum according to claim 8, wherein said first and second air control holes have substantially one and the same radial spacing relative to an axis of rotation of said rotary valve.

10. The sheet transport drum according to claim 8, wherein said first valve part has at least one air control groove formed therein and assigned co-operatively both to said first air control hole and to said second air control hole, so that said first and second air control holes come to overlap said air control groove successively during each drum revolution.

11. The sheet transport drum according to claim 10, wherein said second valve part has at least a third air control hole formed therein, said third air control hole is disposed such that said third air control hole lies on a different imaginary circular arc than said first and second air control holes and comes to overlap said air control groove during each drum revolution.

12. The sheet transport drum according to claim 11, wherein said first air control hole is formed as a passage hole which is open toward said first valve part and toward said third valve part, and said second air control hole and said third air control hole are each formed as one of an angled hole and an oblique hole.

13. The sheet transport drum according to claim 11, further comprising a row of vacuum nozzles for fixing a sheet trailing edge of a printing-material sheet respectively resting on said sheet support surface and are connected to said third air control hole.

14. The sheet transport drum according to claim 4, further comprising a pneumatic coupling connected to said pneumatic grooves, said pneumatic coupling is configured to be adjustable as a function of a sheet format and has two half-couplings.

15. The sheet transport drum according to claim 14, wherein one of said two half-couplings is mounted such that it can be rotated relative to the other as a function of different sheet format lengths.

16. The sheet transport drum according to claim 14, wherein one of said two halt-couplings is an integral constituent part of said rotary valve which applies air cyclically to said pneumatic grooves in dependence on the rotational angle positions assumed by the sheet transport drum during the rotation of the sheet transport drum.

17. The sheet transport drum according to claim 16, wherein said rotary valve contains valve parts resting on one another and are coaxial with one another, and one of said valve parts is formed by said half-coupling that forms said integral constituent part of said rotary valve.

* * * * *